US009763527B2

(12) United States Patent
Resch

(10) Patent No.: US 9,763,527 B2
(45) Date of Patent: Sep. 19, 2017

(54) COOLING SHELF

(71) Applicant: AHT Cooling Systems GmbH, Rottenmann (AT)

(72) Inventor: Reinhold Resch, St. Peter (AT)

(73) Assignee: AHT Cooling System GmbH (AT)

( * ) Notice: Subject to any disclaimer, the term of this patent is extended or adjusted under 35 U.S.C. 154(b) by 0 days.

(21) Appl. No.: 15/117,966

(22) PCT Filed: Feb. 4, 2015

(86) PCT No.: PCT/EP2015/052309
§ 371 (c)(1),
(2) Date: Aug. 10, 2016

(87) PCT Pub. No.: WO2015/121130
PCT Pub. Date: Aug. 20, 2015

(65) Prior Publication Data

US 2016/0353906 A1 Dec. 8, 2016

(30) Foreign Application Priority Data

Feb. 14, 2014 (DE) ..... 20 2014 100 665 U

(51) Int. Cl.
*A47F 3/04* (2006.01)

(52) U.S. Cl.
CPC ..... *A47F 3/0491* (2013.01); *A47F 3/0443* (2013.01); *A47F 3/0452* (2013.01); *A47F 3/0469* (2013.01)

(58) Field of Classification Search
CPC .... A47F 3/0443; A47F 3/0452; A47F 3/0469; A47F 3/0491
(Continued)

(56) References Cited

U.S. PATENT DOCUMENTS 4,103,981 A * 8/1978 Donahue ..... A47B 17/003 108/159.11
4,153,313 A * 5/1979 Propst ..... A47B 81/00 232/43.1
(Continued)

FOREIGN PATENT DOCUMENTS

DE 202006007152 8/2006
ES 2393147 12/2012
(Continued)

*Primary Examiner* — James O Hansen
(74) *Attorney, Agent, or Firm* — Jansson Munger McKinley & Kirby Ltd.

(57) ABSTRACT

A refrigerated display case having a bottom assembly with lower lateral edges, a top assembly with upper lateral edges, a rear wall assembly and side walls; a cooling chamber at the bottom assembly; and lower securing elements in a lower region of the sidewalls and upper securing elements in an upper region of the sidewalls. The lower lateral edges of the bottom assembly near the side walls are provided with securing elements adapted to interact with lower counterpart securing elements and the upper lateral edges of the top assembly near the side walls are provided with upper counterpart securing elements, the side walls being detachably secured to the refrigerated display case by connecting the lower securing elements to the lower counterpart securing elements and by connecting the upper securing elements to the upper counterpart securing elements.

7 Claims, 20 Drawing Sheets

(58) Field of Classification Search
USPC ..... 312/116, 401, 406.2, 265.5, 265.6; 62/440, 458
See application file for complete search history.

(56) References Cited

U.S. PATENT DOCUMENTS

| | | | | |
|---|---|---|---|---|
| 5,517,826 | A * | 5/1996 | Duffy | A47F 3/0443 312/116 |
| 6,089,393 | A * | 7/2000 | Revelli | A21B 3/00 220/4.31 |
| 6,560,842 | B1 | 5/2003 | Kusel et al. | |
| 7,784,889 | B2 * | 8/2010 | Benner | H02B 1/32 312/223.1 |

FOREIGN PATENT DOCUMENTS

| | | |
|---|---|---|
| JP | S5443655 | 3/1979 |
| JP | S6152179 | 4/1986 |
| JP | 2000083772 | 3/2000 |

* cited by examiner

COOLING SHELF

CROSS-REFERENCE TO RELATED APPLICATION

The present application is a U.S. national phase entry of pending International Patent Application No. PCT/EP2015/052309, international filing date Feb. 4, 2015, which claims priority to German Patent Application No. DE 20 2014 100 665.6, filed Feb. 14, 2014, the contents of which are incorporated by reference in their entireties.

FIELD OF THE INVENTION

The device relates to a refrigerated display case with a bottom assembly, a rear wall assembly, a top assembly, and side walls that establish a cooling chamber at the bottom, the rear, the top, and the sides.

BACKGROUND OF THE INVENTION

A refrigerated display case of this kind is disclosed in DE 20 2006 007 152 U1. The refrigerated display case has a bottom module, a rear wall module, a top module, and a stand module with rear vertical stand profiles whose top ends are welded to projecting upper crossbeams and whose lower ends are welded to forward-projecting lower crossbeams that are inserted into a recess in the bottom module and screw-mounted there. Insulated side walls are fastened to the lateral ends of the refrigerated display case; no further details are provided regarding the fastening method. Usually, the side walls are screw-mounted to the lateral edges of the end; the mounting of the side walls requires corresponding mounting work.

OBJECTS OF THE INVENTION

An object of the present invention is to create a refrigerated display case of the type mentioned at the beginning, which facilitates the mounting of the side walls.

In the present device, the side walls are provided with lower securing elements in their lower region and provided with upper securing elements in their upper region; the lower lateral edges of the bottom assembly oriented toward the side walls are provided with counterpart securing elements adapted to the lower securing elements and the upper lateral edges of the top assembly oriented toward the side walls are provided with upper counterpart securing elements; and the side walls are detachably secured to the side regions of the refrigerated display case by connecting the lower securing elements to the lower counterpart securing elements and by connecting the upper securing elements to the upper counterpart securing elements. These measures produce a simple construction with easy-to-perform mounting steps.

SUMMARY OF THE INVENTION

In accordance with the present device, a refrigerated display case including a bottom assembly with lower lateral edges, a top assembly with upper lateral edges, a rear wall assembly and side walls; a cooling chamber at the bottom assembly; and lower securing elements in a lower region of the sidewalls and upper securing elements in an upper region of the sidewalls. The lower lateral edges of the bottom assembly near the side walls are provided with securing elements adapted to interact with lower counterpart securing elements and the upper lateral edges of the top assembly near the side walls are provided with upper counterpart securing elements, the side walls being detachably secured to the refrigerated display case by connecting the lower securing elements to the lower counterpart securing elements and by connecting the upper securing elements to the upper counterpart securing elements.

Two preferable alternative embodiment variants with an advantageous construction and easy-to-perform mounting steps are comprised in the fact that each respective side wall can first be hung at an angle from above with its lower securing elements in the lower counterpart securing elements and can then be pivoted against the upper lateral edge of the rear wall assembly and the top assembly and can be secured with its upper securing elements to the upper counterpart securing elements by retaining elements to prevent it from being lifted out of the lower counterpart securing elements or in the fact that each respective side wall can first be hung with its upper securing elements in the upper counterpart securing elements and can then be pivoted against the lower lateral edge of the rear wall assembly and the bottom assembly and can be secured with its lower securing elements to the lower counterpart securing elements by retaining elements to prevent it from being removed from the upper counterpart securing elements.

Preferably an additional measure is that the retaining elements are retaining screws.

It is highly preferred that the construction and mounting are comprised in the fact that the lower securing elements are embodied in the form of securing angles with a fastening leg that is mounted to a lower edge of the respective side wall extending inward at a right angle to the plane of the side wall and with a downward-oriented hanging leg and in the fact that the lower counterpart securing elements are embodied as counterpart securing angles with another fastening leg that is mounted to the respective lateral edge of the bottom assembly and with an outward-protruding hanging leg.

A simple mounting with an advantageous construction is also promoted by the fact that the upper securing elements are embodied in the form of securing angles with an inward-oriented fastening leg that is mounted to an upper edge of the respective side wall at a right angle to the plane of the side wall and with an upward-oriented connecting leg; by the fact that the upper counterpart securing elements are embodied as Z-shaped angled elements with a downward-oriented additional fastening leg, an outward-oriented middle support leg, and an upward-oriented counterpart connecting leg; and by the fact that the connecting leg and the counterpart connecting leg are each provided with a longitudinal slot, one of which slots is oriented vertically and the other of which is oriented horizontally and which are brought into alignment and connected by a retaining screw.

A stable attachment of the side walls with an advantageous mounting is also achieved by the fact that on each side of the refrigerated display case, a C-shaped side frame is provided, which has a vertical side strut extending along the lateral edge of the rear wall assembly, a top side strut connected to the upper end section thereof and extending along the lateral edge of the top assembly, and a bottom side strut connected to the lower end section of the vertical strut and extending along the lateral edge of the bottom assembly and by the fact that the upper counterpart securing elements are mounted to the top side strut and/or the lower counterpart securing elements are mounted to the bottom side strut directly or indirectly by intermediate elements.

Another highly-preferred feature is regarding the side walls. The side walls each include an upper region, rear region, and lower region. These regions are composed of an exterior metal plate, which is bent inward toward the cooling chamber at right angles to the plane of the plate along its rear, upper, and lower edges.

BRIEF DESCRIPTION OF THE DRAWINGS

The drawings illustrate a preferred embodiment including the above-noted characteristics and features of the device. The device will be readily understood from the descriptions and drawings. In the drawings.

DETAILED DESCRIPTION OF PREFERRED EMBODIMENTS

Figure 1:
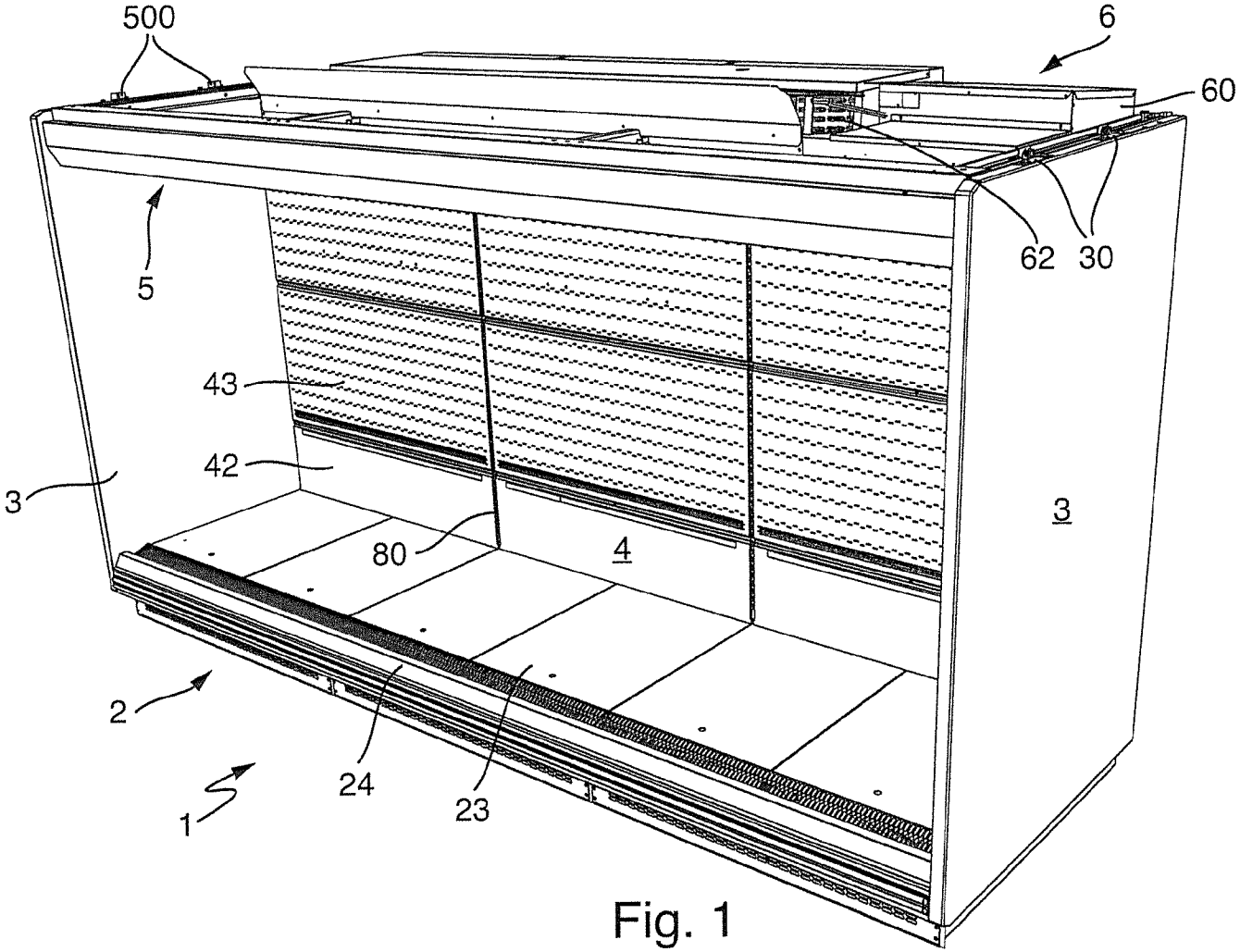
FIG. 1 is a perspective view of a refrigerated display case, in an oblique view from above, with a bottom assembly, a rear wall assembly, a top assembly, and two side walls.

Referring to FIGS. 1-6E, a refrigerated display case 1 in accordance with the present invention is generally designated by the reference numeral 1. FIG. 1 illustrates a refrigerated display case 1 in a perspective view with a bottom assembly 2, a rear wall assembly 4, a top assembly 5, and two side walls 3 delimiting a cooling chamber at the bottom, the rear, the top, and the sides. To cool the cooling chamber and products contained therein, a cooling device 6 is provided, some of whose components, namely a cooling unit 60 with a control unit and a heat exchanger 62, are shown, which are accommodated in or on the top assembly 5. Other components of cooling device 6, such as flow ducts for the cooling air, compressors, and fans, are accommodated in rear wall assembly 4 and bottom assembly 2.

Bottom assembly 2 is closed toward the front by a pedestal cover unit 24 and toward the cooling chamber by a plurality of plate-shaped bottom covering elements 23 and includes one or more thermally insulating bottom cover elements, for example composed of a plastic foam as well as sections of cooling air ducts that transition at the back into corresponding sections of cooling air ducts in rear wall assembly 4.

In the direction toward the cooling chamber, rear wall assembly 4 is closed by a plurality of plate-shaped elements, namely lower rear wall elements 42 and rear wall elements 43 situated above the latter; in particular, the rear wall elements 43 are provided with numerous openings to allow cooling air to flow out into the cooling chamber. FIG. 1 also shows vertical support struts 80, which serve to stabilize refrigerated display case 1 frame (not otherwise visible in this figure) and which are also embodied for attachment of the rear wall elements 42, 43 and for hanging support arms (likewise not shown) that protrude forward into the cooling chamber for holding shelves, for which purpose the support struts 80 are provided with rows of holes spaced a particular distance apart. In addition, rear wall assembly 4 and top assembly 5 are provided with thermally insulating insulation plates that enclose the outside of the cooling ducts relative to the cooling chamber. Side walls 3 can likewise be clad with thermal insulation material or be composed thereof. The cooling air flow assisted by the fans travels in a largely closed circular flow through bottom assembly 2, rear wall assembly 4, and top assembly 5, and in a cooling air curtain that travels from top to bottom across the front side; it flows out and down through a laminar cover in top assembly 5 and travels through a laminar grating and back into the sections of the cooling air ducts in bottom assembly 2. In the front region of top assembly 5, a roller curtain for closing the cooling chamber can be provided, e.g. to keep the cooling air in the cooling chamber during non-business hours.

Figure 2:
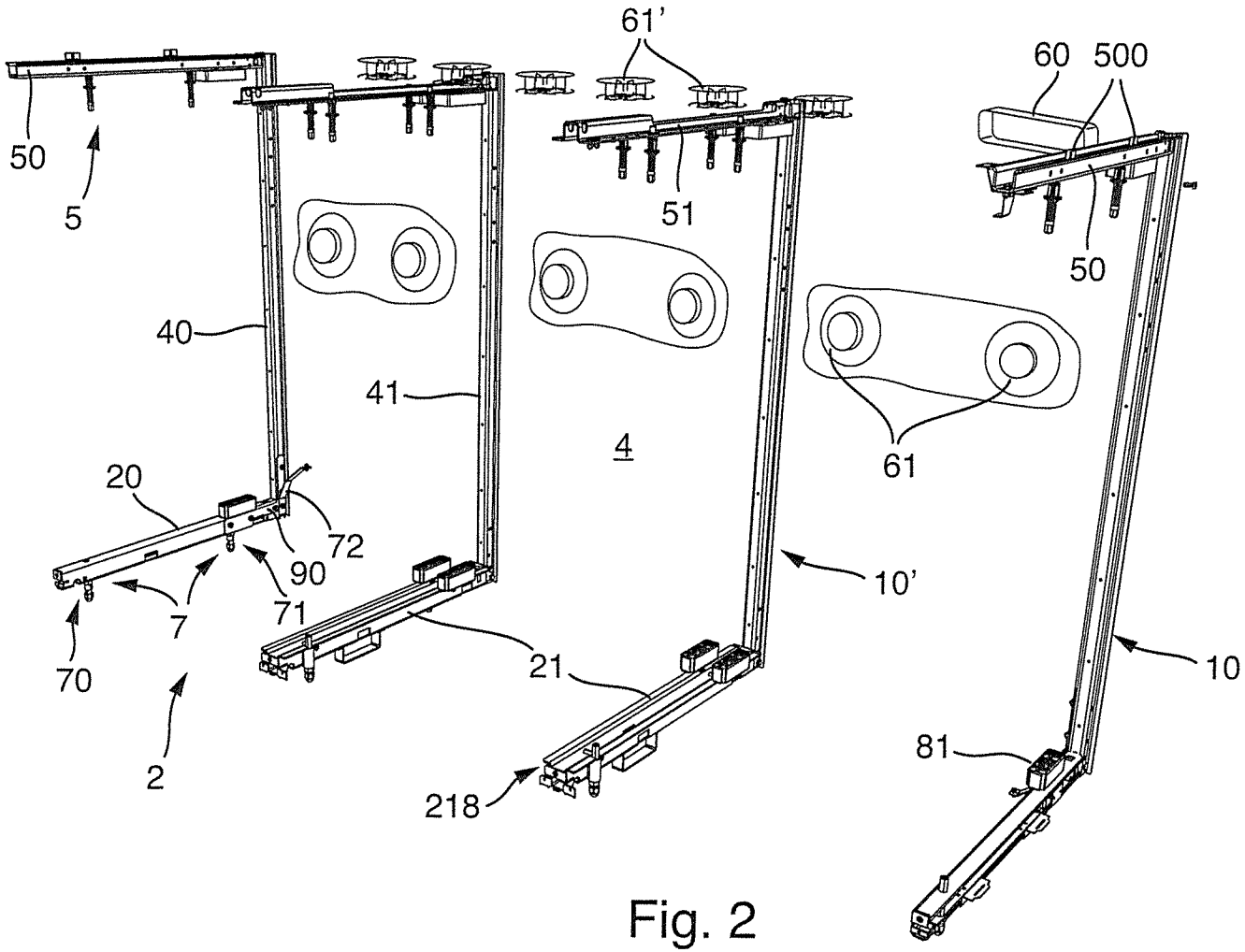
FIG. 2 is a perspective view of the frame of the refrigerated display case with C-shaped side frames and intermediate frames as well as components of a cooling device.

As FIG. 2 shows, refrigerated display case 1 has a support structure in the form of a frame with a plurality of frames that are C-shaped when viewed from the side, namely two side frames 10 and intermediate frames 10' situated between the latter and preferably spaced equidistantly apart from one another; two intermediate frames 10' are shown in FIG. 2. The distance between successive frames corresponds, for example, to the width of a conventional shelf module 1.25 m wide (one column); the shelf arrangement in FIGS. 1 and 2 is embodied with three columns and, for example, is 3.75 m wide. Intermediate frames 10' produce an advantageous, stable, continuous connection of the shelf modules. Frames 10 and intermediate frames 10' in this case are arranged on the outside of refrigerated display case 1 in relation to the cover panels—particularly in relation to the thermally insulating insulation plates—so as to avoid cold bridges to the outside and also to facilitate the assembly steps during setup of the refrigerated display case 1. On the underside, frames 10 and intermediate frames 10' are provided with a bottom support 7, which has front and rear feet 70, 71. Also in the exemplary embodiment shown, an adjustable securing support element 72 is embodied at the bottom of the back of the side frame 10 to provide additional steadiness.

FIG. 2 also shows fans 61 provided in the rear wall assembly 2 and fans 61' provided in the top assembly.

Side frames 10 each have a vertical side strut 40, which is attached at its bottom end to a bottom side strut 20 protruding forward in the depth direction and is attached at its top end to a top side strut 50 protruding forward in the depth direction. Intermediate frames 10' each have a vertical intermediate strut 41, which is attached at its bottom end to a bottom intermediate strut 21 protruding forward in the depth direction and is attached at its top end to a top intermediate strut 51 protruding forward in the depth direction. In order to connect the vertical side strut 40 to bottom side strut 20 (possibly in addition to other connecting elements), a stiffening bracket 90 can be mounted in the lower region, with one leg oriented toward the front along the bottom side strut 20 and the other oriented upward along vertical side strut 40. Bottom struts 20, top struts 50, bottom intermediate struts 21, and top intermediate struts 51 are preferably oriented horizontally and at right angles to associated vertical struts 40 and vertical intermediate struts 41.

To stiffen frames 10 and intermediate frames 10', between bottom strut 20 and respective top strut 50 and between bottom intermediate strut 21 and top intermediate strut 51, support struts 80 shown in FIG. 1 are mounted in the rear region of refrigerated display case 1, spaced apart by the same distance from vertical struts 40 and vertical intermediate struts 41; the ends of the support struts 80 are supported on bottom strut 20 or bottom intermediate strut 21 by thermally insulating support blocks 81 and corresponding thermally insulating elements are also situated between the upper end of support strut 80 and associated top strut 50 or top intermediate strut 51 in order to avoid cold bridges to the frame parts situated on the outside since support struts 80 and also the horizontal and vertical frame legs in the form of vertical side struts 40, vertical intermediate struts 41, bottom side struts 20, bottom intermediate struts 21, top side struts 50, and top intermediate struts 51 are preferably composed of metal, in particular steel, in order to ensure the required stability and favorable mounting options.

Support struts 80 that are built into intermediate frame 10' also have, for example, mounting flanges on both sides, which are bent parallel to the plane of the rear wall. On support struts 80 incorporated into side frames 10, however, there is preferably only one mounting flange oriented toward the inside, parallel to the plane of the rear wall, while there is no mounting flange oriented toward the outside.

As FIG. 2 also shows, side frames 10 and intermediate frames 10' are designed differently. Vertical side struts 40 are embodied in the form of profiles with a hat-shaped cross-section, i.e., with a middle section that is U-shaped in cross-section and with the free ends of the U-legs bent outward at right angles. This design achieves advantageous mounting options; the U-piece and the U-legs that are bent outward at right angles constitute flange-like mounting surfaces, which are parallel to and spaced apart from one another by a definite distance and in which mounting bores can be provided at suitable locations.

Top side struts 50 of the side frames are also embodied in the form of a profile with a hat-shaped cross-section corresponding to that of the vertical struts 40. In both the vertical struts 40 and top struts 50, the profile cavity is open toward the outside. This achieves a stable mounting of the frame elements to one another and also provides advantages in the mounting of the plate-shaped cover panels and side walls 3. The bottom side struts, by contrast, are preferably embodied in the form of a closed rectangular or square hollow profile or in the form of a C-shaped profile, permitting a high degree of stability in connection with bottom support 7 and simultaneously good mounting options for vertical struts 40 and side walls 3.

In intermediate frames 10', vertical intermediate struts 41 and top intermediate struts 51 are likewise composed of a profile with a hat-shaped cross-section, with the profile dimensions in the cross-section advantageously corresponding to the profile dimensions of vertical struts 40 and top struts 50. Top intermediate struts 51, however, are oriented with their open side oriented downward toward the cooling chamber in order to provide better mounting options on the inside of the cooling chamber and on the outside of top assembly 5. To this end, top intermediate struts 51 are provided with cutouts 510 on top, which, in the example shown, extend approximately from the front third into the vicinity of the rear end.

For example, components of cooling device 6 such as a heat exchanger 62 can be definitely positioned in the cutouts on top. Bottom intermediate struts 21 are likewise composed of a profile with a hat-shaped cross-section, with the opening of the profile cavity oriented upward toward cooling chamber. The resulting angled side flanks situated at the top provide advantageous mounting surfaces for the covering elements and e.g., for support blocks 81. On the side flanks of the U-legs of the middle profile section, front and rear feet 70, 71 are accommodated in a stable, adjustable fashion in corresponding sockets. The profile cross-section of bottom intermediate struts 21 is wider than the profile cross-section of the vertical and top intermediate struts 41 and 51 in order to achieve more favorable mounting options.

Figure 3:
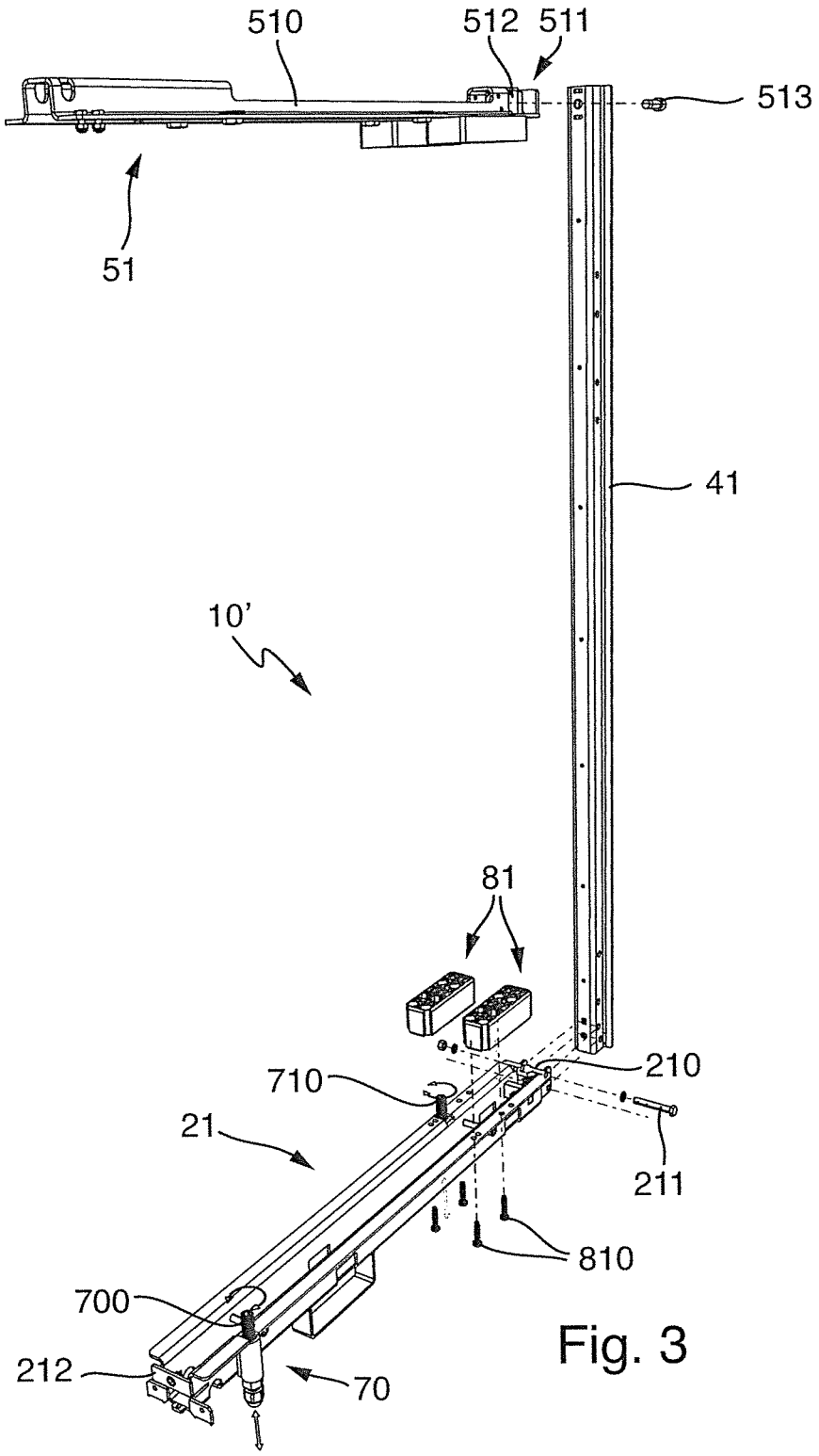
FIG. 3 is an exploded view of an intermediate frame.

FIG. 3 shows a perspective, exploded view of an intermediate frame 10'. In this case, the top intermediate strut with its cutout 510 is clearly visible; cutout 510 is adjoined by a rear, upper fastening section 511, the end of which is brought into contact with the part of the U-section of vertical intermediate strut 41 oriented toward it, either directly or indirectly with the interposition of an intermediate piece, and is clamped by a fastener 513 in the form of a fastening screw that is inserted from the rear side through a corresponding bore in the vertical intermediate strut 41. The fastening screw in this case is screwed into a threaded fastening bore provided in a fastening piece 512 that is inserted into transverse slots which are provided in the top intermediate strut 51 at right angles to the longitudinal axis of the strut.

The connection of the lower section of vertical intermediate strut 41 to bottom intermediate strut 21 is also provided at the end of bottom intermediate strut 21. For this purpose, in a bottom, rear fastening section 210 of bottom intermediate strut 21, a contact piece is inserted, to which vertical intermediate strut 41 is fastened, as described in greater detail below.

FIG. 3 also shows the mounting of thermally insulating support blocks 81, which are composed of a stable plastic material, to the outward-oriented flange-like sections of bottom intermediate strut 21 by fastening screws 810. FIG. 3 also shows the mounting of front and rear foot 70, 71 to bottom intermediate strut 21. To this end, a respective socket is mounted to each of the U-legs of the U-section of bottom intermediate strut 21, which socket is provided with or connected to an internal thread in order to accommodate a threaded bolt 700, 710 of front or rear foot 70 in a vertically adjustable fashion. The threaded bolt protrudes upward beyond the top surface of bottom intermediate strut 21 and in its upper section, has a fitting for a tool such as a socket for an Allen wrench. This design allows front and rear foot 70, 71 to be easily adjusted from above, i.e., from the interior of the refrigerated display case, as shown by the arrows pointing in the rotation direction and the vertical direction. In particular, even rear foot 71, which is shifted toward the front approximately into the vicinity of the support strut 80 and in fact, somewhat forward of the longitudinal axis thereof, can be easily actuated in this way for the vertical adjustment. Support blocks 81 and possible cover elements have corresponding access openings or can be easily removed from the vicinity of the tool fitting. Front and rear feet 70, 71 are mounted on the two different legs of the U-section, which also provides an increased stability.

Figure 4A:
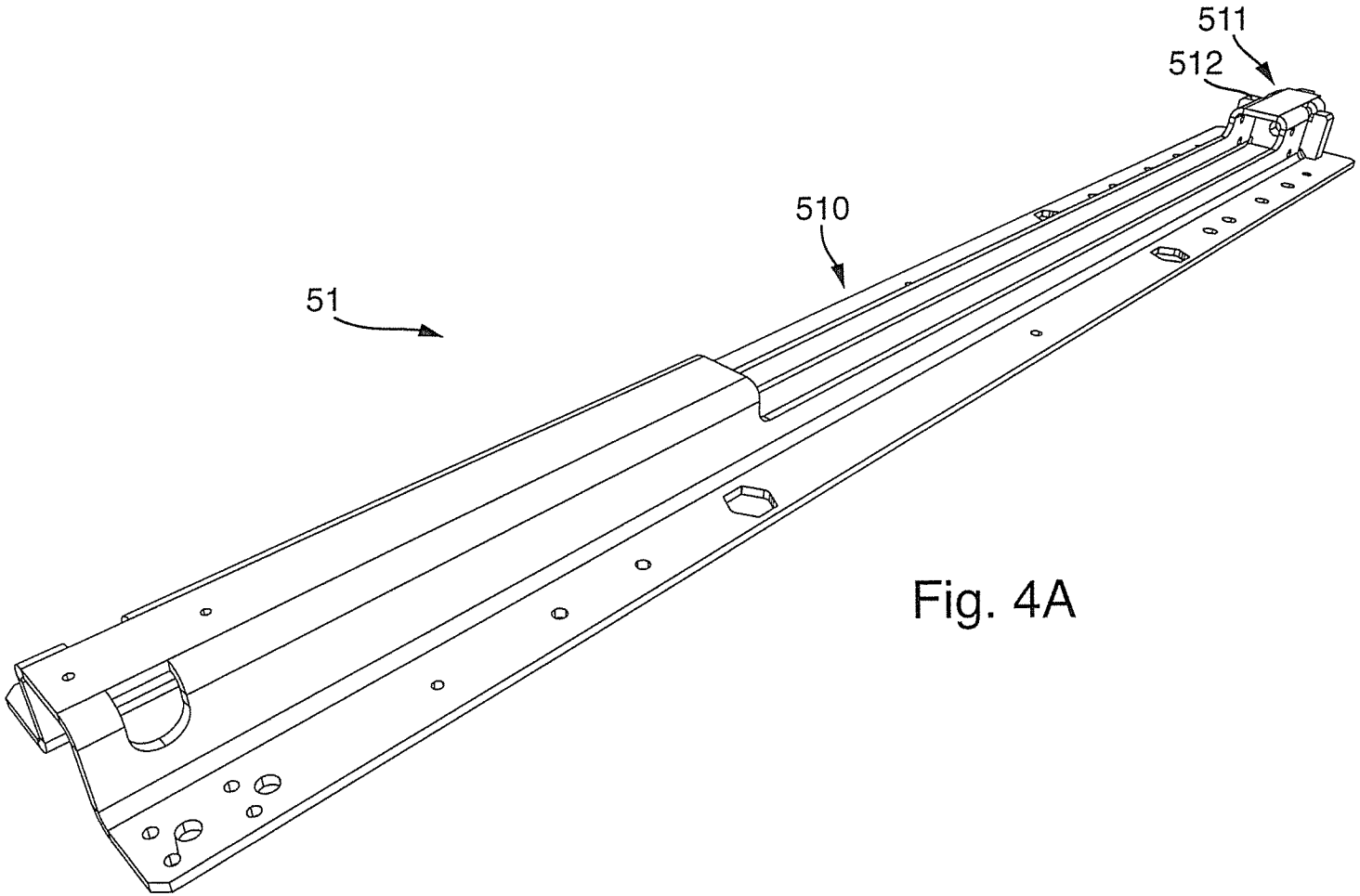
FIG. 4A is a perspective view of a top intermediate strut of the intermediate frame.

FIG. 4A is an enlarged depiction of top intermediate strut 51, with upper fastening section 511 and fastening piece 512, which is inserted into a transverse slot therein and which is provided with a threaded bore for above-mentioned fastening screw 513 for attaching vertical intermediate strut 41. Cutout 510 in the upward-oriented U-section of the profile is also clearly visible. Mounting openings for mounting relevant components are provided in the U-piece and in the legs that are bent outward at right angles.

Figure 4B:
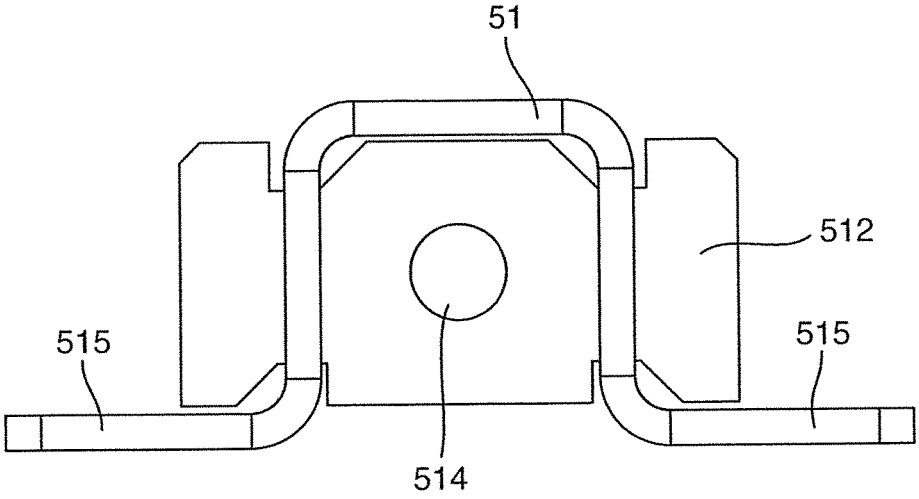
FIG. 4B is a rear view of the top intermediate strut according to FIG. 4A.

FIG. 4B shows a rear view of top intermediate strut 51; bore 514, which is preferably provided with an internal thread, is situated in the middle region of fastening piece 512, whose lateral segments protrude outward over the U-legs of top intermediate strut 51 through the transverse slot provided therein. In order to be able to favorably center vertical intermediate strut 41, fastening piece 512 is inserted into the transverse slot with play and has respective holding notches in the region of the U-legs of top intermediate strut 51. To facilitate the insertion and securing of fastening piece 512 that is inserted into the transverse slot with play, the fastening piece has two groove-shaped recesses at the top and bottom in the region of the U-legs; the lower recesses are provided with inclined flanks on the outside and steep flanks on the inside while the upper recesses are provided steep flanks on the outside and inclined flanks on the inside. FIG. 4B also shows the angled flange (side flange) 515 of intermediate strut 51.

Figure 4C:
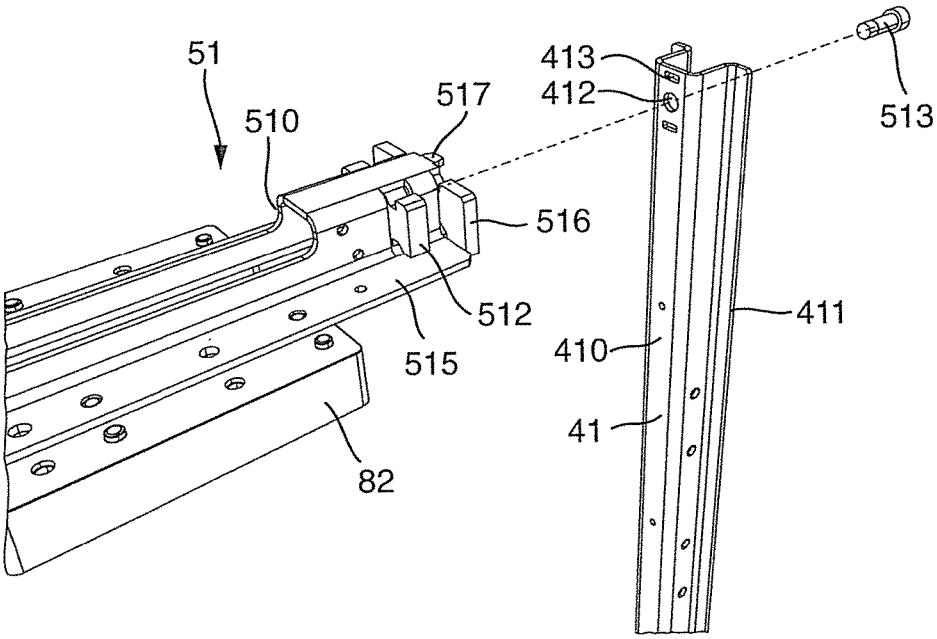
FIG. 4C is a perspective view of a detail of the intermediate frame in its upper rear corner, in an exploded view of the top intermediate strut and the vertical intermediate strut.

FIG. 4C shows upper rear fastening section 511 of top intermediate strut 51 and the associated section of the respective vertical intermediate strut 41. At the end of top intermediate strut 51, at right angles to the longitudinal axis of the intermediate strut, an intermediate piece 516 is mounted, which constitutes a defined, stable contact for the U-piece of vertical intermediate strut 41. Above intermediate piece 516, an edge of the U-piece of top intermediate strut 51 protrudes, the end of which is connected to a fixing lug 517 that protrudes even further, which is inserted into an adapted receiving opening 413 in the upper section of vertical intermediate strut 41 and constitutes a positioning aid. Then fastener 513 embodied in the form of a clamping screw can be inserted through a precisely positioned bore 412 and a matching bore (not shown in the drawing) in intermediate piece 516 and screwed into the threaded bore of fastening piece 512 in order to clamp vertical intermediate strut 41 to top intermediate strut 51.

FIGS. 5A through 5E show rear region of bottom intermediate strut 21 with rear foot 71 and lower section of vertical intermediate strut 41. U-legs of vertical intermediate strut 41 are inserted between rearward-protruding lateral fixing lugs 212, which protrude rearward from the U-legs of bottom intermediate strut 21 or from a contact piece 213 that is placed against the rear end of bottom intermediate strut 21; the distance between the lateral fixing lugs 212 is adapted to the distance between the outsides of the U-section of the vertical intermediate strut 41. The lateral fixing lugs 212 and the U-legs of the vertical intermediate strut 41 are provided with openings that are to be brought into alignment and through which the securing screw 211 is transversely guided in order to clamp the vertical intermediate strut 41 to the bottom intermediate strut 21. To facilitate positioning and fixing, the upper edge of the contact piece 213 has an additional fixing lug 212 protrudes rearward, which engages in a fixing opening 414 that is adapted to it in position and shape and is provided in the U-piece of the vertical intermediate strut 41. Contact piece 213 can, for example, be fastened by a securing screw that is inserted in a direction axial to bottom intermediate strut 21 into a threaded bore provided in a clamping piece, which is slid into a transverse slot in the bottom intermediate strut 21.

Figure 5A:
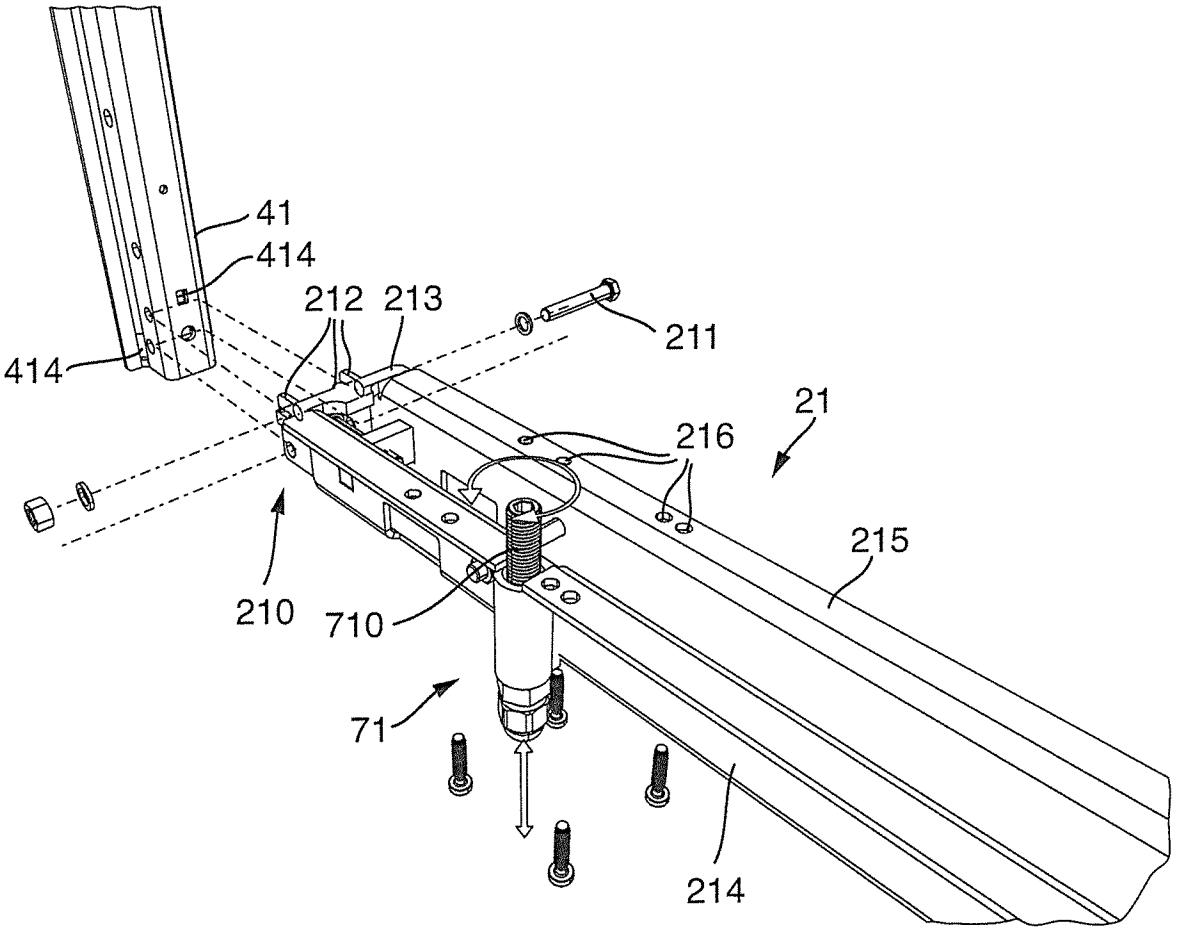
FIG. 5A is a perspective view of a detail of the intermediate frame in its lower corner region, in an exploded view of the vertical intermediate strut and the bottom intermediate strut with a rear foot.
Figure 5B:
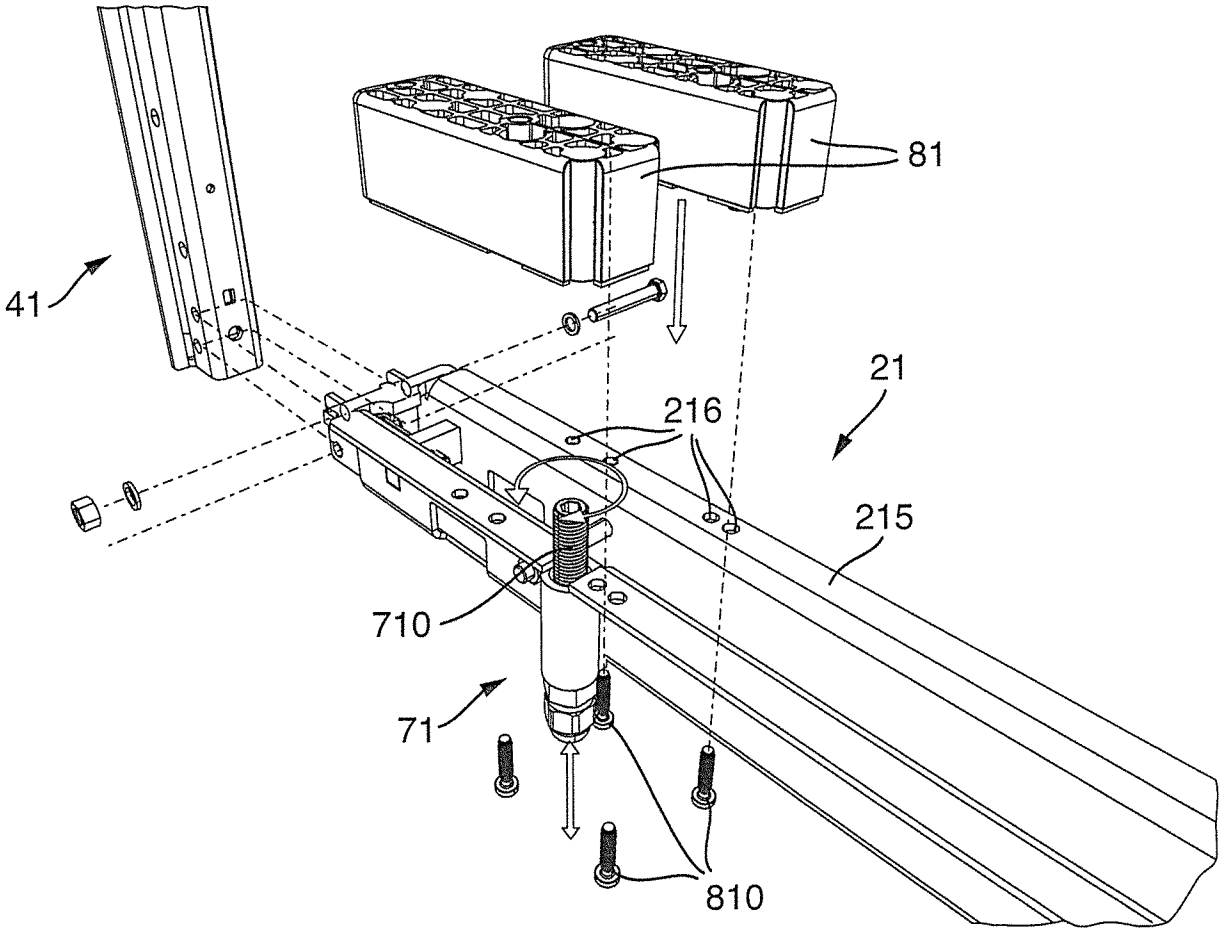
FIG. 5B is a detailed view of the intermediate frame corresponding to that in FIG. 5A, also depicting support blocks.

FIG. 5A also shows rear foot 71, which is secured in a stable fashion in a cylindrical socket to a side leg of the U-section 214 of bottom intermediate strut 21. The socket is itself provided with an internal thread or is connected to a nut equipped with an internal thread so that threaded bolt 710 of rear foot 71 is guided in a vertically adjustable fashion in the vertical direction. Threaded bolt 710, which is provided with the tool fitting an Allen socket in the exemplary embodiment, protrudes beyond the top surface of bottom intermediate strut 21; respective outward-angled flange section 215 has an opening at the point through which threaded bolt 710 passes. In order to increase the stability, particularly in the vicinity of rear foot 71 (and likewise in the region of front foot 70), a screw can be inserted transversely through the U-section of bottom intermediate strut 21 in order to stabilize the alignment of the U-legs. In bent flange sections 215, fastening bores 216 are also provided to allow fastening screws 810 to pass through, e.g., for the support blocks 81. FIG. 5B shows the mounting of support blocks 81 by fastening screws 810. The drawing also once again shows the above-described fastening of the vertical intermediate strut 41 to bottom intermediate strut 21 and the mounting and vertical adjustment of rear foot 71, with the rotation and vertical adjustment symbolized by arrows.

Figure 5C:
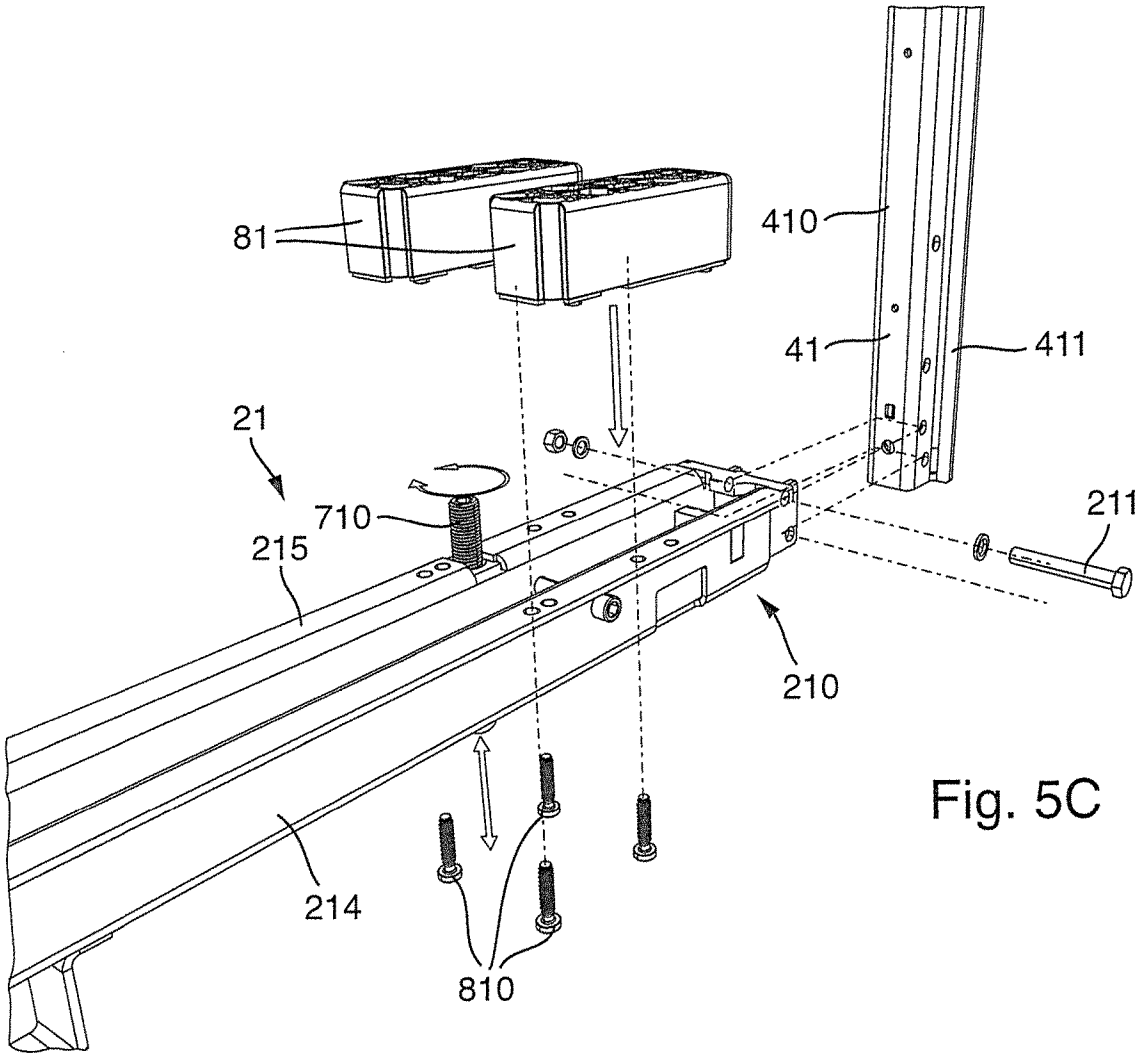
FIG. 5C is a perspective view of the detail of the intermediate frame corresponding to that in FIG. 5B, in a perspective view from an opposite side.

FIG. 5C shows the attachment of vertical intermediate strut 41 by a U-section 410 to bottom intermediate strut 21; the side flange sections 411 of vertical intermediate strut 41 protrude beyond the end of lateral fixing lugs 212 in the clamped state. In this case, fixing lugs 212, as can also be the case in the exemplary embodiments shown in FIGS. 5A and 5B, are embodied as protruding sections of the U-legs of bottom intermediate strut 21; in this case, contact piece 213 is accommodated between lateral fixing lugs 212 and only in its upper region, by sections protruding laterally beyond fixing lugs 212, rests with its end in particular against the stepped, outward-angled flange sections 215 of bottom intermediate strut 21 and is supported with its end in a stable fashion in the lower region, for example, against the correspondingly stepped U-piece. FIG. 5C also once again shows rear foot 71 mounted on bottom intermediate strut 21, with threaded bolt 710 and the mounting of support blocks 81 by fastening screws 810 in a perspective view from the other side in comparison to FIG. 5B.

Figure 5D:
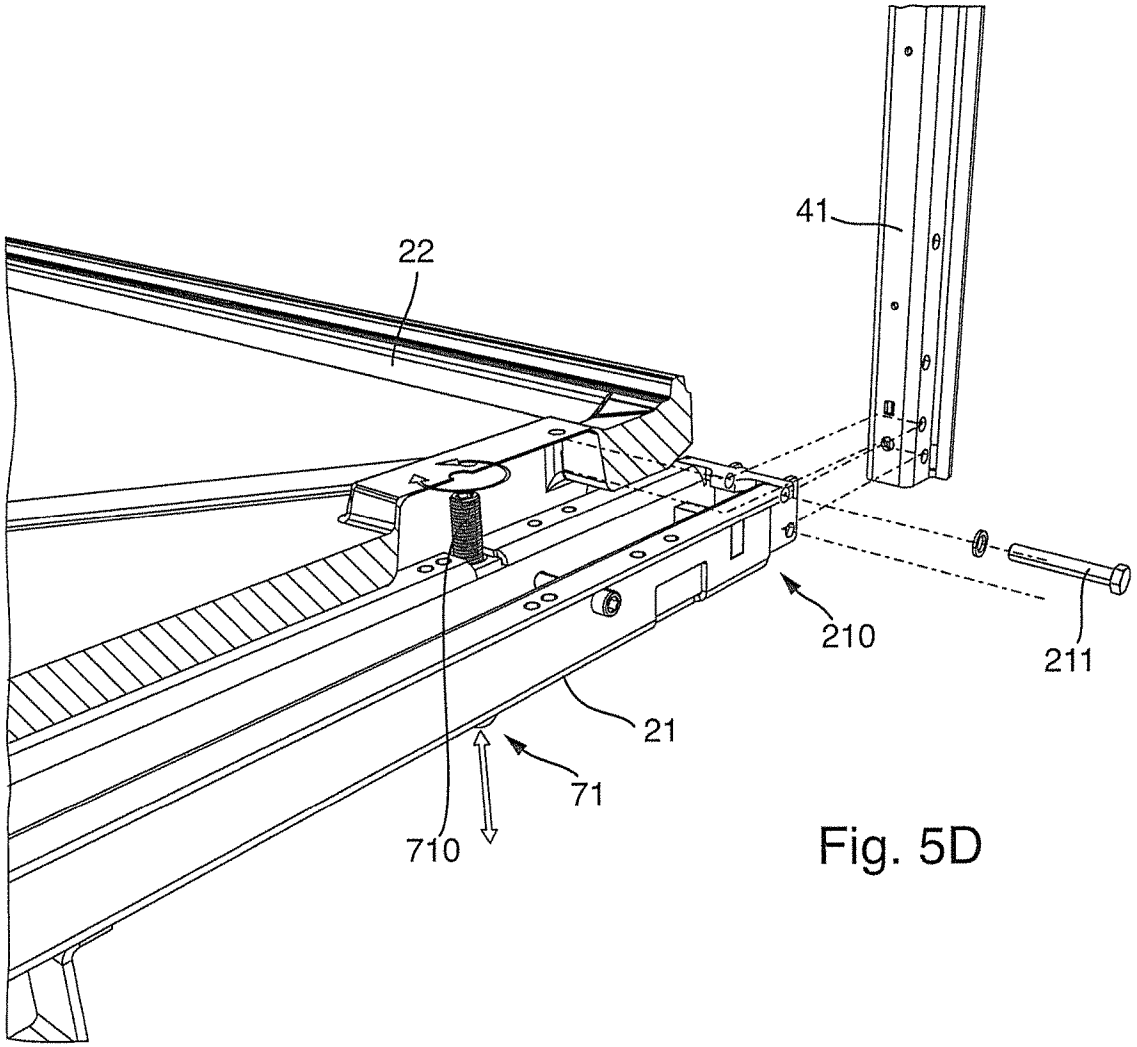
FIG. 5D is a perspective view of the intermediate frame according to FIG. 5C, with an insulating bottom cover element without support blocks.

FIG. 5D also shows the mounting of vertical intermediate strut 41 to bottom intermediate strut 21 in the above-described way. It also shows rear foot 71 with threaded bolt 710. As an additional component, the drawing shows a thermally insulating bottom covering element 22, e.g., made of a plastic foam, which is placed onto the angled flange section 215 of bottom intermediate strut 21 oriented toward it and can be fastened to this flange section, for example, by screws or other fasteners. In the vicinity of threaded bolt 710, bottom covering element 22 is provided with an opening for permitting the vertical adjustment tool to be inserted into threaded bolt 710 and turned in order to perform the vertical adjustment. As is clear from FIG. 5D, on the underside of bottom covering element 22, an opening is provided into which support block 81 can be inserted, which likewise has a corresponding opening for threaded bolt 710. Since a widened foot of vertical support strut 80 is placed on top of support block 81, this achieves a high stability in the region of rear foot 71 that is supported on the floor. The capacity to be adjusted from above achieves a simple operation of rear foot 71, which is spaced toward the front, apart from the back of refrigerated display case 1.

Figure 5E:
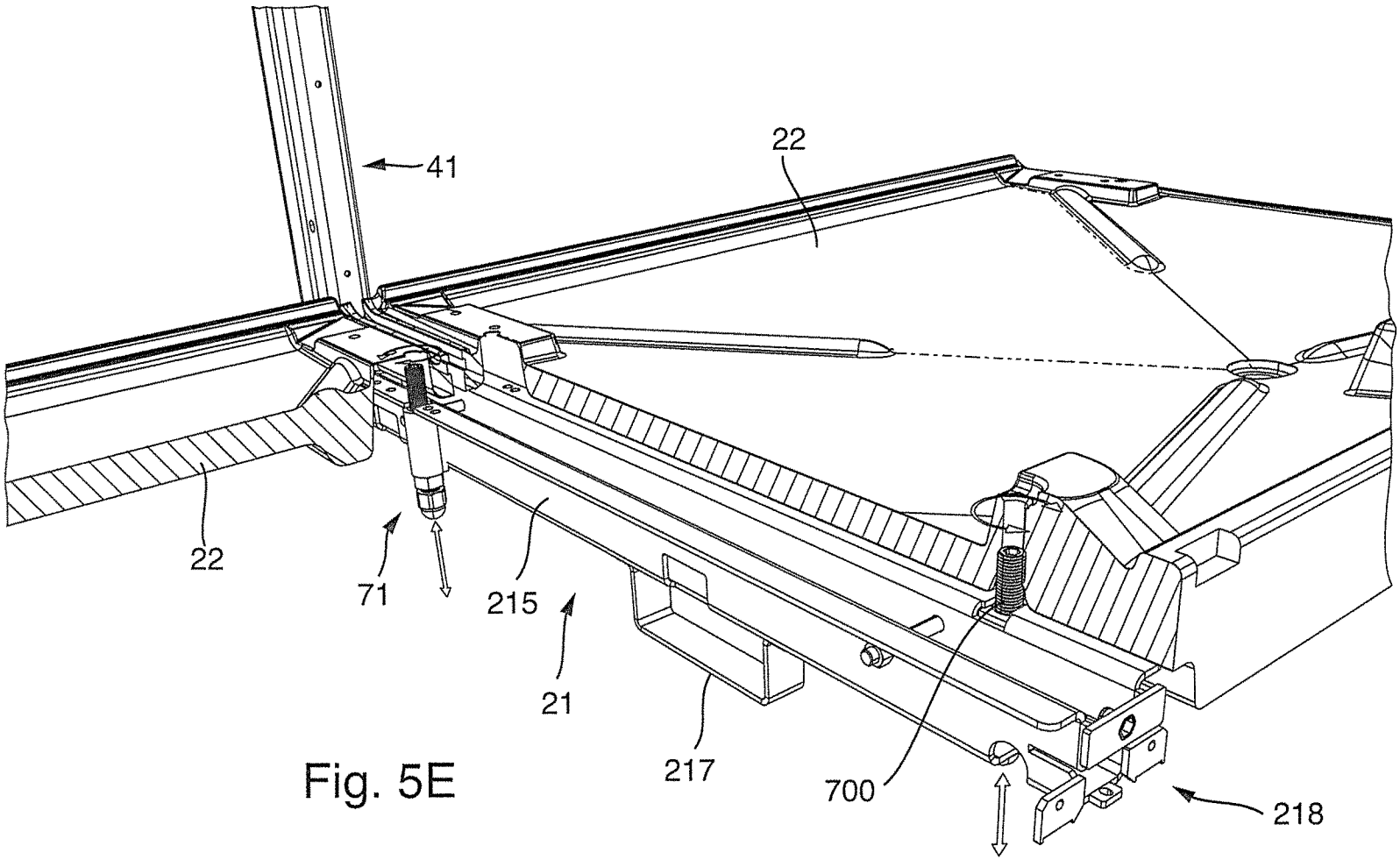
FIG. 5E is a perspective view of the intermediate frame in the lower region, with a bottom intermediate strut, a vertical intermediate strut, and two plate-shaped insulating bottom cover elements that are positioned on the bottom intermediate strut and are depicted in a partially cut-away view.

FIG. 5E shows the entire length of bottom intermediate strut 21, whose rear fastening section has vertical intermediate strut 41 mounted to it in the above-described fashion. In the exemplary embodiment shown, separate thermally insulating bottom covering elements 22 are laid onto two flange sections 215, between which a seal (not shown) is inserted to produce a seal, which has a mushroom-shaped cross-section, for example. In addition to rear foot 71, which is mounted to bottom intermediate strut 21 in the above-described fashion and is adjustable from above, FIG. 5E also shows front foot 70 with threaded bolt 700, whose upper section is likewise provided with a tool fitting, e.g., an Allen socket, and is accessible from above via an opening in the front region of respective bottom covering element 22 to perform a vertical adjustment. The mounting of front foot 70 is preferably embodied in a corresponding fashion to that of rear foot 71, as described above. In this case, however, the cylindrical socket is mounted to the U-leg of the U-section of bottom intermediate strut 21 opposite from that of rear foot 71 and front foot 70 is situated against this U-leg. The vertical adjustment can thus be easily performed from above. The vertical adjustment is thus not hindered even if front foot 70 is shifted a greater or lesser distance toward the rear from the front edge of the refrigerated display case 1. As an additional support option, FIG. 5E shows a bracket-like support section 217 that protrudes downward from the U-piece of bottom intermediate strut 21 and is connected to the U-piece.

In addition, in its front section, bottom intermediate strut 21 is provided with a front fastening section 218 to which front pedestal elements or cover elements can be attached. For this purpose, front fastening section 218 has flat contact sections oriented at right angles to the longitudinal axis of bottom intermediate strut 21 at the end of bottom intermediate strut 21.

Figure 5F:
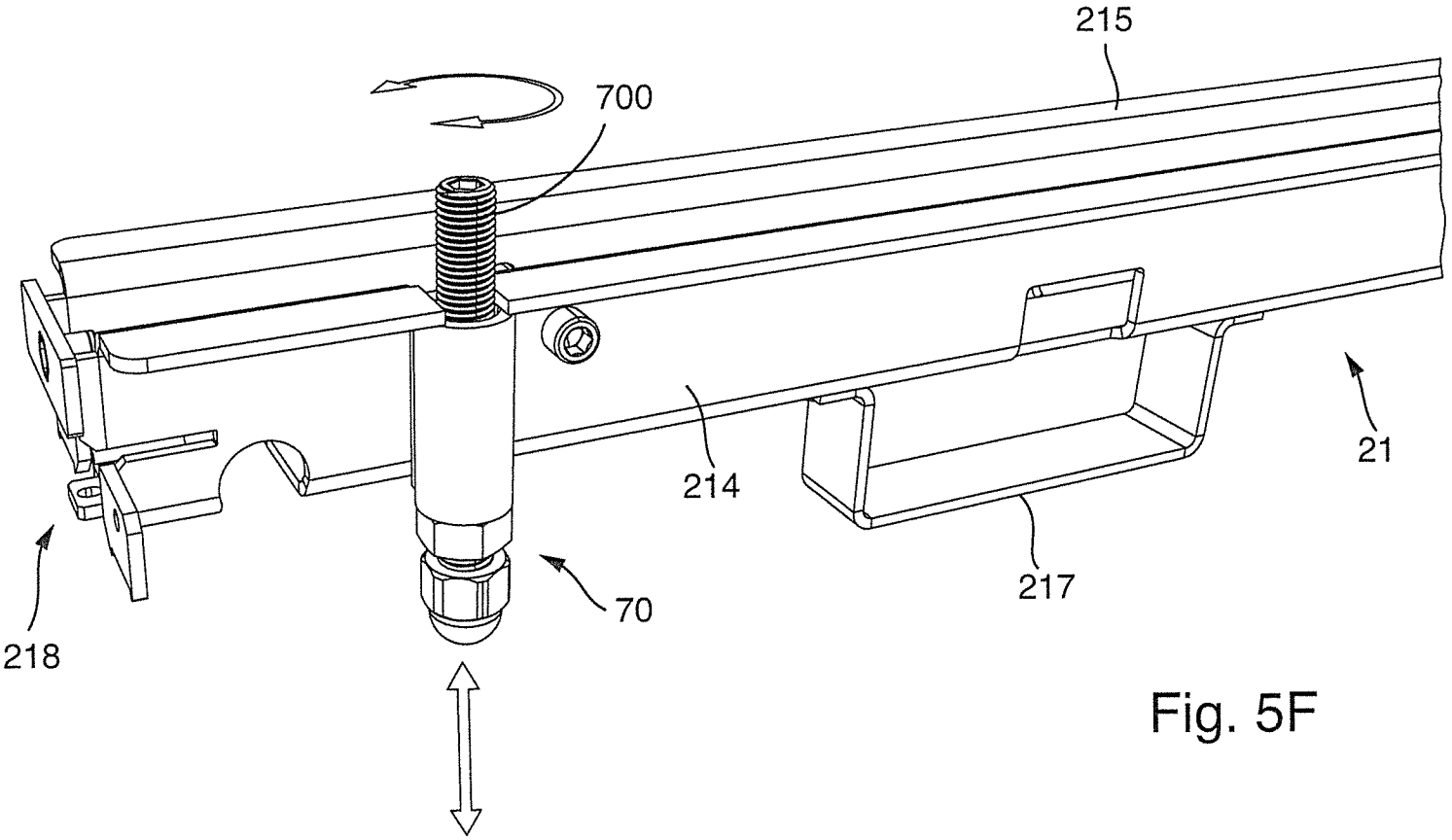
FIG. 5F is a perspective view of a front section of the bottom intermediate strut with a front foot.

FIG. 5F shows an enlarged perspective view of the front section of bottom intermediate strut 21, seen from the other side in comparison to FIG. 5E. The drawing shows front fastening section 218, support section 217, and the vertically adjustable embodiment of front foot 70 with threaded bolt 700 and its attachment to the one U-leg of bottom intermediate strut 21. In the region of threaded bolt 700, respective angled flange section 215 of bottom intermediate strut 21 likewise has an opening, as in the vicinity of rear foot 71.

Figure 5G:
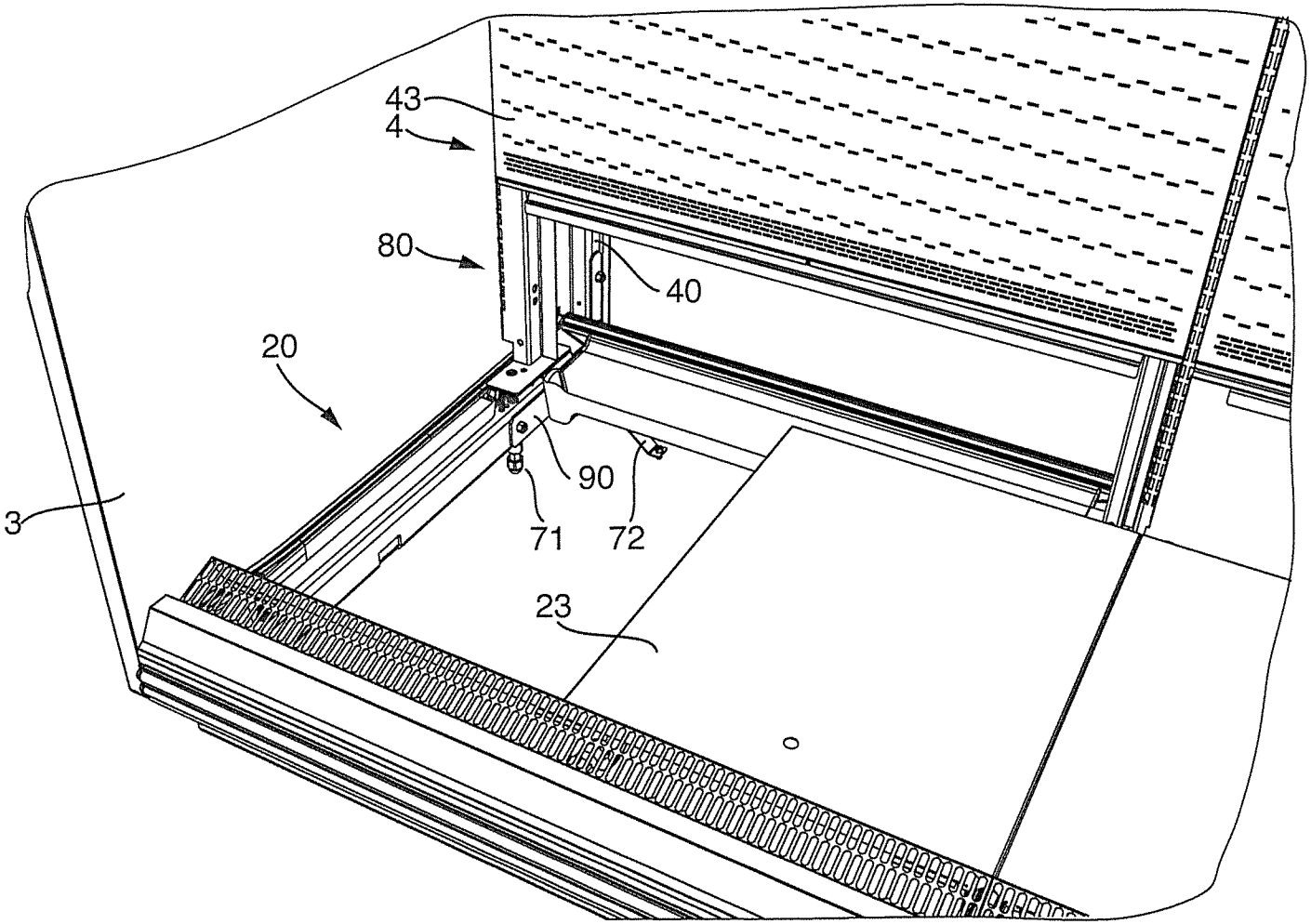
FIG. 5G is a perspective view showing the detail of the refrigerated display case in its lower end region, with a partially covered bottom assembly, a rear assembly, and a side wall.

FIG. 5G shows a lower, side section of the display case, with a section of the rear wall assembly 4, rear wall elements 43, vertical side strut 40, and support struts 80; a section of bottom assembly 2, with a bottom side strut 20, rear foot 71 and bottom covering element 23; a section of the pedestal cover unit 24; and a section of a side wall 3. The drawing also shows connecting bracket 90 between vertical side strut 40 and bottom side strut 20 and also shows securing support element 72 in the rear region, which has been brought into the support position. To make it easier to access, rear foot 71 has been shifted forward relative to support strut 80 and for the vertical adjustment, is accessible from above via an opening in the foot of support strut 80. The positioning of rear foot 71 close to the longitudinal axis of support strut 80 makes it possible to absorb heavy weights that can be exerted in this rear region of the display case. On the one hand, specifically in the rear wall region between vertical side struts 40 or vertical intermediate struts 41 and support struts 80 spaced apart from them toward the front, various cooling components—in particular heat exchangers, evaporators, fans 61, and possibly compressors—can be contained in the resulting intermediate space in rear wall assembly 4 and on the other hand, support arms, which protrude forward into the cooling chamber and are for the products to be contained, are hung on support struts 80.

Figure 5H:
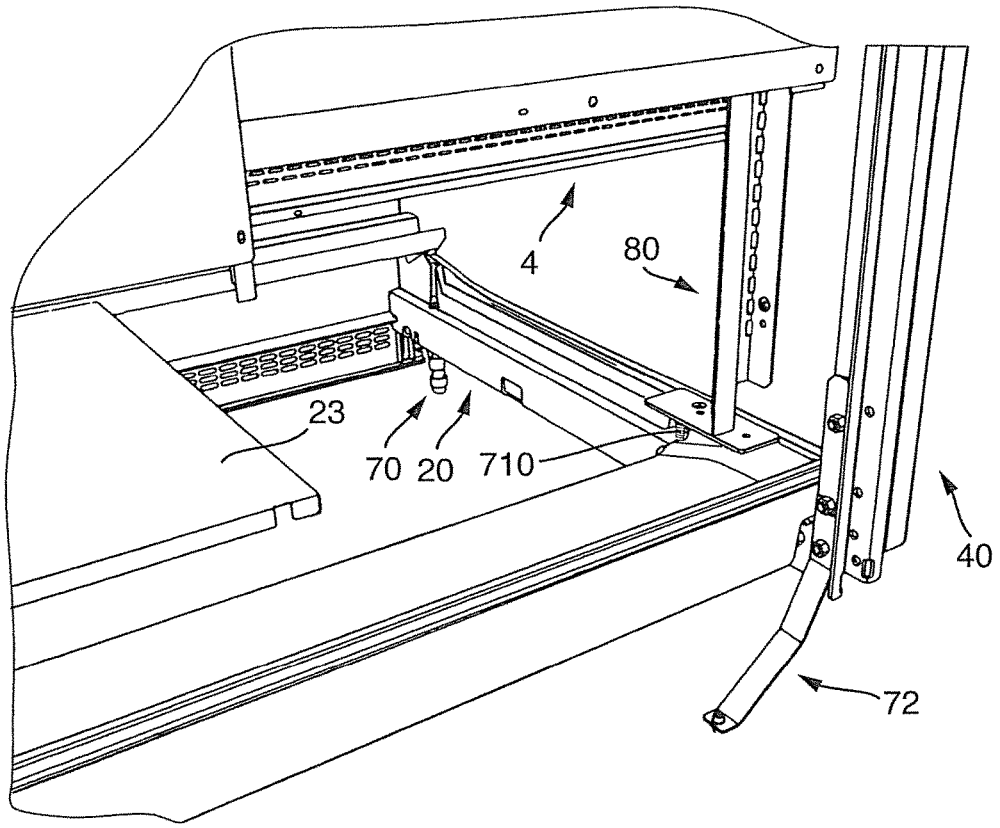
FIG. 5H is a perspective view showing the detail of the refrigerated display case according to FIG. 5G.

Similarly to FIG. 5G, FIG. 5H shows a detail of a lower corner region of refrigerated display case 1, but in a perspective view from the rear. Here, too, the drawing shows bottom side strut 20 and vertical side strut 40 attached to rear fastening section 210 thereof, as well as support strut 80, which is supported with its foot on the top surface of bottom side strut 20. The drawing also shows front foot 70 and threaded bolt 710 of rear foot 71 as well as securing support element 72, which is shown brought into the support position and which is fastened to vertical side strut 40 in a removable or vertically pivotable fashion by screws.

Figure 5I:
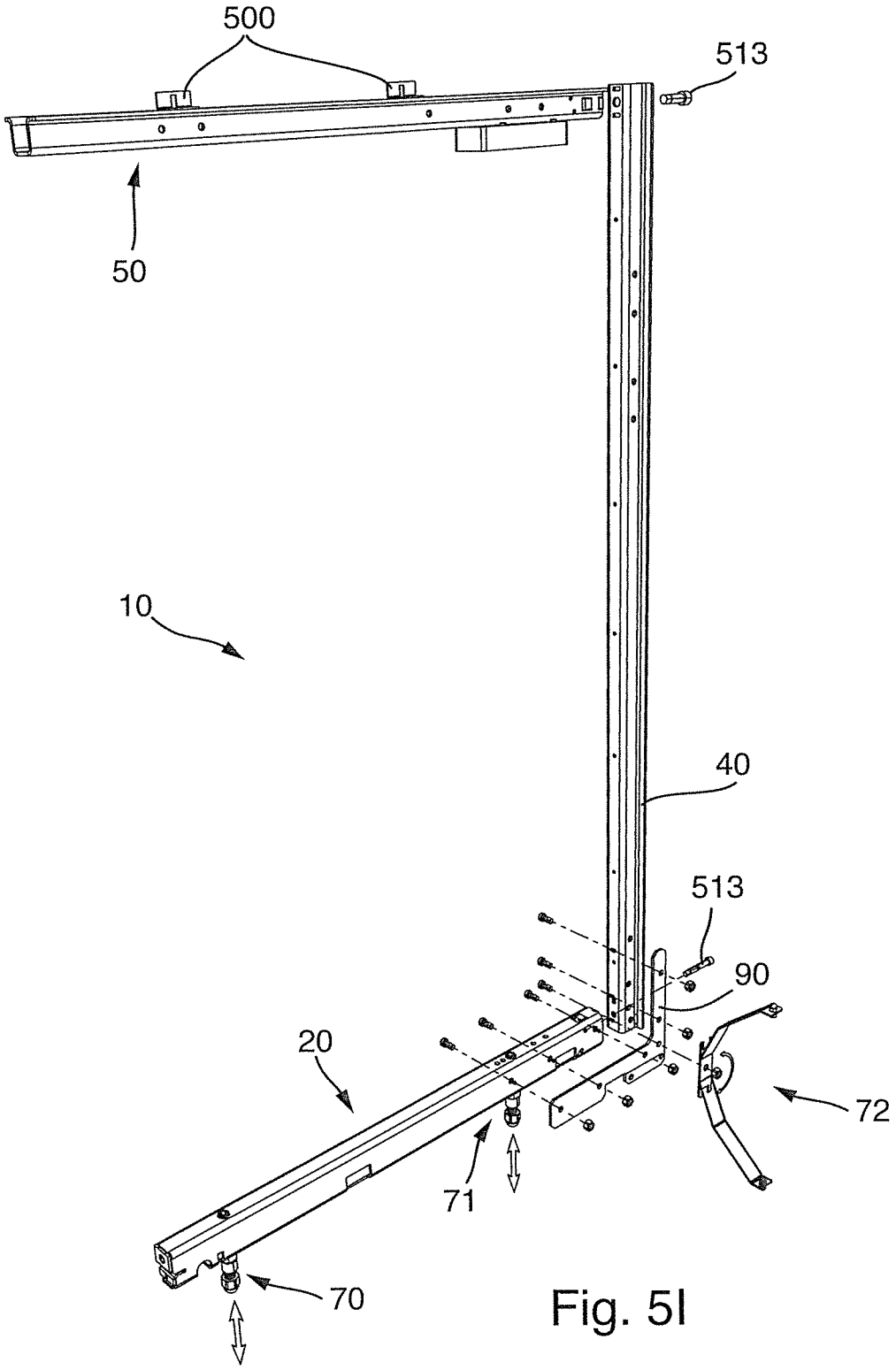
FIG. 5I is an exploded view of the side frame.

FIG. 5I shows a side frame 10 with a vertical side strut 40, a top side strut 50, and a bottom side strut 20 in a perspective, exploded view. Vertical side strut 40 is fastened to the rear fastening section of top side strut 50 in a fashion corresponding to that described above in connection with the intermediate frame 10'. By contrast with top intermediate struts 51, though, top side strut 50 in this case is rotated by 180° with its open side upward and also has no cutout in the U-section region since no mounting options—or at least only a few of them—are required for top-mounted units such as cooling components of cooling device 6 situated on top and in addition, advantages are achieved with regard to stability and side wall mounting, as explained further below.

Vertical side strut 40 is once again connected to top side strut 50 by a clamping screw; the U-piece of vertical side strut 40 is clamped against the rear end of top side strut 50 with or without the interposition of an intermediate piece.

The U-piece of the rear section of vertical side strut 40 is clamped against the end of bottom side strut 20 with or without the interposition of an intermediate piece. In the rear end section of the bottom side strut, a fastening piece with an internal thread, e.g., inserted into a transverse slot in the bottom side strut, is used for mounting vertical side strut 40 in a stable fashion by a fastener 513, in particular a clamping screw that is inserted through an adapted opening in the U-piece of vertical side strut 40. In this regard, in the exemplary embodiment shown, the connection between vertical side strut 40 and bottom side strut 20 is embodied differently from the connection between vertical intermediate strut 41 and bottom intermediate strut 21 and corresponds more to the fastening approach used between the upper section of vertical side strut 40 and top side strut 50.

In addition, the lower section of vertical side strut 40 and the rear section of bottom side strut 40 are connected to each other via stiffening bracket 90 by fasteners 900 in the form of clamping screws; stiffening bracket 90 is brought into contact with the inside of the U-leg of vertical side strut 40 oriented toward the cooling chamber and into contact with the inner side profile segment of bottom side strut 20 oriented toward the cooling chamber and is screw-mounted there so that stiffening bracket 90 can absorb heavy weights.

FIG. 5I also shows front and rear feet 70, 71 that protrude from the underside of bottom side strut 20, which feet can likewise be advantageously embodied as vertically adjustable from above or can also be adjustable from the side since they are situated close to the lateral edge of the refrigerated display case 1. Feet 70, 71 are secured to the lower profile segment and preferably also, to the upper profile segment, of bottom side strut 20 since bottom side strut 20 is embodied as a square, rectangular or a C-shaped hollow profile, as described above. In the drawing, securing support element 72 is shown pivoted upward, i.e., not in the supporting position, and is detachably mounted to the lower end section of vertical side strut 40.

Figure 5J:
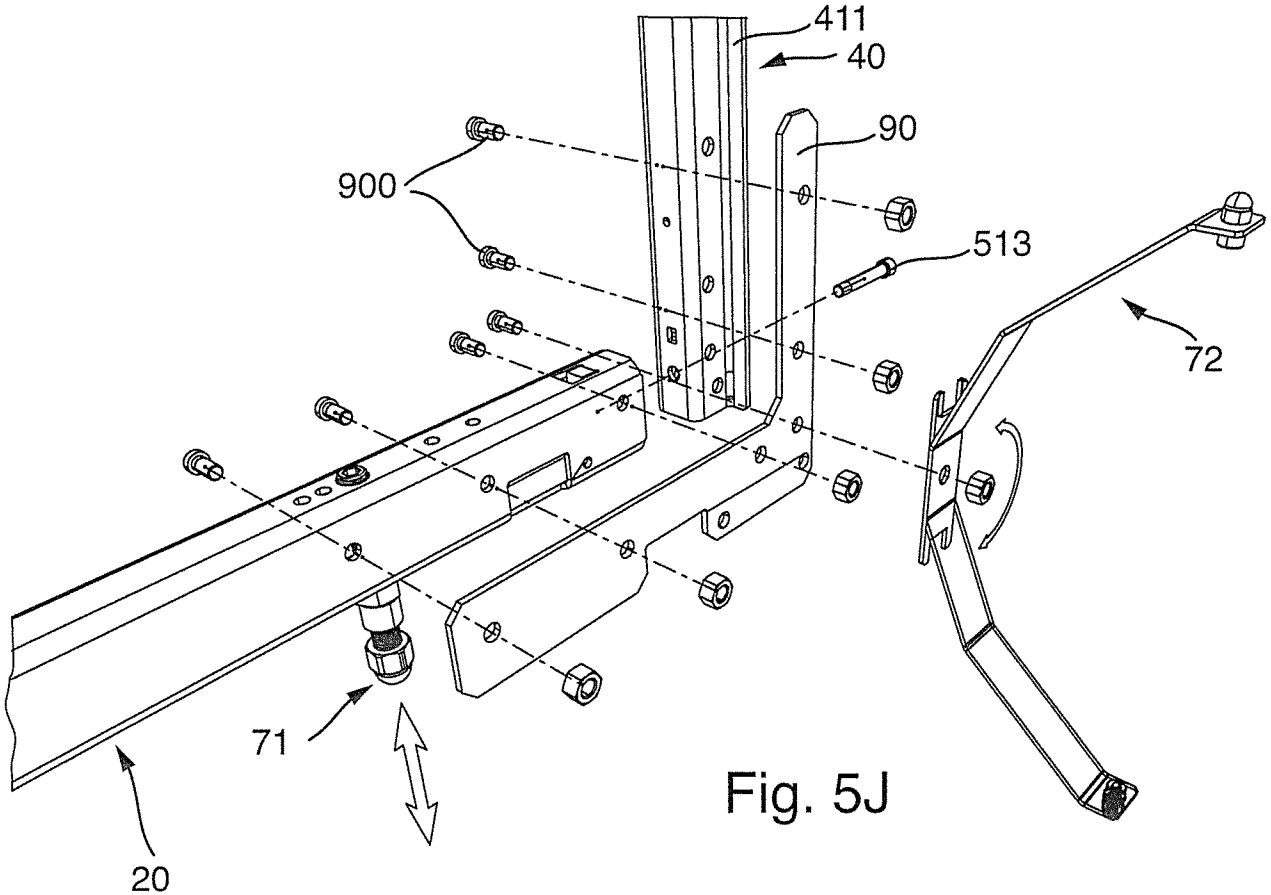
FIG. 5J is a perspective, exploded view of a lower, rear corner region of the side frame according to FIG. 5I

FIG. 5J shows an enlarged depiction of the rear lower corner region of side frame 10 according to FIG. 5I. This depiction shows the passage of threaded bolt 710 of rear foot 71 through bottom side strut 20 through the lower and upper profile segments (lower and upper wall sections of bottom strut 20) as well as the adjustability from above. Cover panels or support elements or the like that are placed onto bottom strut 20 are provided with openings in the axial direction of threaded bolt 710 so that the tool fitting of threaded bolt 710, e.g., an Allen socket, can be easily accessed from above.

The drawing also shows fastener 513 in the form of the clamping screw for clamping the U-piece of vertical strut 40 against the end of bottom strut 20 oriented toward it, connecting bracket 90 to be mounted to vertical strut 40 and bottom strut 20 by fasteners 900, and securing support element 72 pivoted upward into the non-supporting position. Flange section 411 that is oriented inward parallel to the rear wall also constitutes a stable support for the upward oriented leg of stiffening bracket 90 and also for the edge of securing support element 72 lying parallel thereto.

Figure 6A:
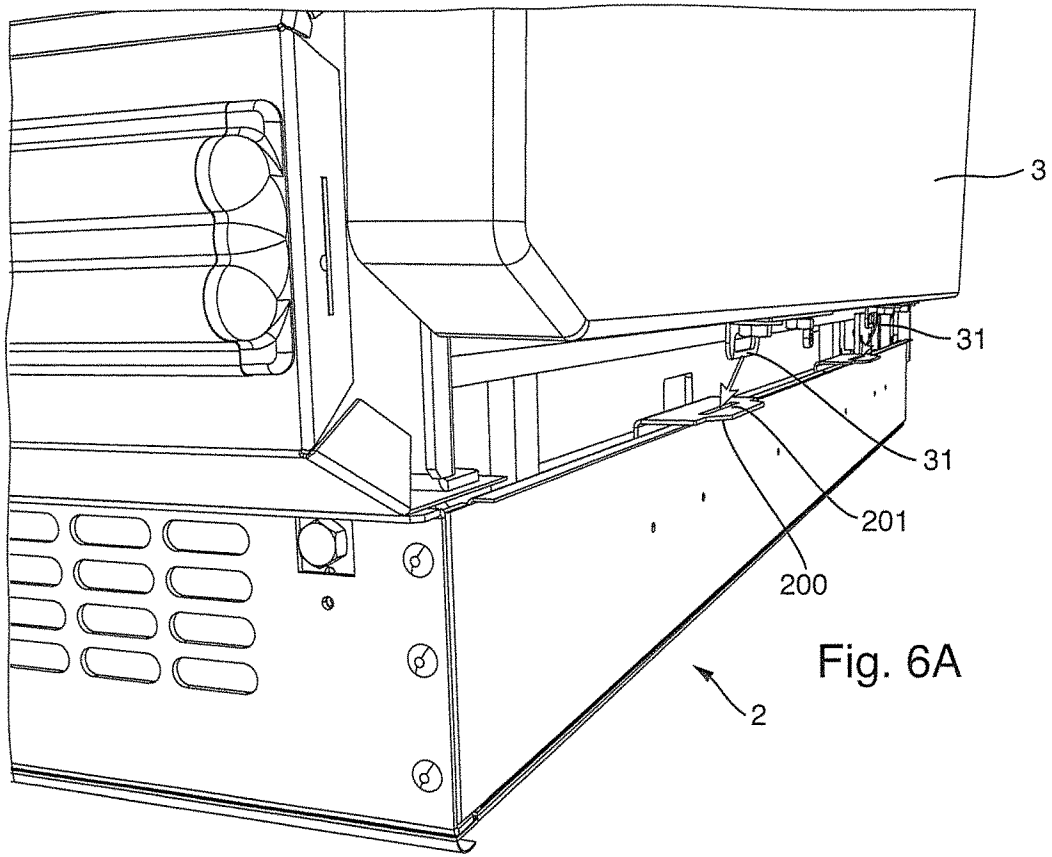
FIG. 6A is a perspective view of the detail of the refrigerated display case in a lower side region before insertion of the side wall.

FIGS. 6A through 6E show the positioning and fastening of side walls 3 in greater detail. On the side of the top side struts oriented toward the outside relative to refrigerated display case 1, as already shown in FIG. 5I, upper counterpart securing elements 500 are mounted, which have upward protruding tab-like securing legs provided with longitudinal slots, which in the example shown, are oriented vertically. In the lower side region of refrigerated display case 1, lower counterpart securing elements are mounted, as shown in FIG. 6A. Side wall 3 is mounted to upper counterpart securing elements 500 by upper securing elements and is secured to lower counterpart securing elements 200 by lower securing elements, as described below.

FIG. 6A shows the one lower side region of refrigerated display case 1 with respective side wall 3 that is to be mounted thereto. Lower counterpart securing elements 200 are embodied as angled, with one downward-oriented leg parallel to the side wall in the side pedestal region being mounted in a stable fashion directly to bottom side strut 20, e.g., to its outside, or indirectly via an intermediate element such as a laterally stable pedestal rail that is fastened to bottom side strut 20. The second leg of lower counterpart securing element 200 protrudes over the side pedestal rail at right angles to the lateral plane of refrigerated display case 1 and also at right angles to side wall 3 mounted thereon.

In the laterally protruding leg of lower counterpart securing element 200, an insertion opening 201 is provided, which in the exemplary embodiment shown is embodied as a longitudinal slot oriented parallel to the side wall. At least two such counterpart securing elements 200 are mounted to the lower lateral edge region of refrigerated display case 1, spaced apart from each other and at an appropriate height, as shown in FIG. 6A. Lower securing elements 31 are mounted to respective side wall 3 in a position that is matched to the position of lower counterpart securing elements 200. In the exemplary embodiment shown, lower securing elements 31 are mounted to a lower edge that is oriented inward and extends at a right angle to the plane of side wall 3, which is why lower securing elements 31 are likewise embodied as angled and are provided with a downward-oriented leg parallel to the plane of side wall 3, which is matched to insertion opening 201 and can be inserted into it. With the upper angled leg, lower securing elements 31 are mounted, in particular screwed, to the lower edge of side wall 3 that is oriented inward and extends at a right angle. In accordance with the number of lower counterpart securing elements 200, side wall 3 is provided on its lower edge with a plurality of lower securing elements 31 that are matched in their position and dimensions to the lower counterpart securing elements 200 and their insertion openings 201.

Figure 6B:
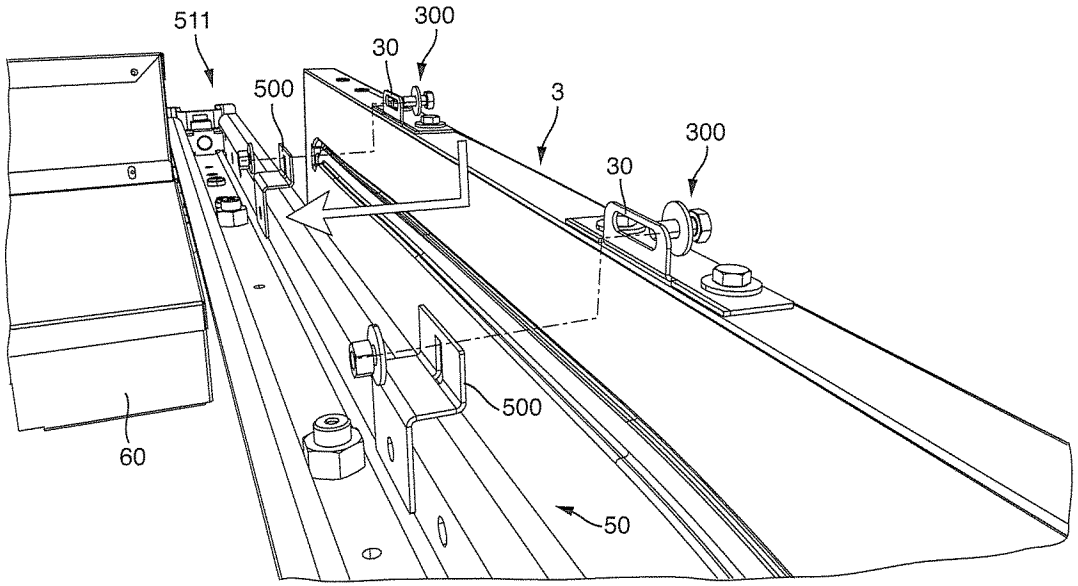
FIG. 6B is a perspective view of the detail of the refrigerated display case in its upper side region with a symbolic depiction of mounting steps.

In a first mounting step, side wall 3 is inserted with its lower securing elements 31 into the insertion openings 201 from above and then is brought into contact along the lateral edges of rear wall assembly 4 and top assembly 5 that are oriented toward it, as symbolically depicted with an arrow in FIG. 6B.

As also shown in FIG. 6B, upper counterpart securing elements 500 are embodied as Z-shaped, with a lower leg oriented parallel to the side wall resting against the inside of the outer U-leg of top side strut 50 and the middle leg resting on the outward-oriented flange section of top side strut 50 and extending to its outer edge. In the exemplary embodiment shown, two upper counterpart securing elements 500 are situated spaced apart from each other along the length of top side strut 50 extending in the depth direction and are fastened for example by screws in the downward-oriented legs to the outer U-leg of top strut 50 by screws; it is also possible, however, to use other fasteners. The outer, upward-oriented legs of upper counterpart securing elements 500 are provided with the above-mentioned slot-shaped openings, which are oriented vertically in the exemplary embodiment shown.

Upper securing elements 30 that are matched in their positions and dimensions to upper counterpart securing elements 500 are mounted to respective side wall 3 and side wall 3 is fastened to upper counterpart securing elements 500 for example by securing screws 300 or other securing devices. In the exemplary embodiment shown, upper securing elements 30 are mounted to an upper edge oriented inward toward the cooling chamber at right angles and have a rectangular shape in cross-section. A leg oriented perpendicular to the plane of the side wall 3 in this case is brought into contact with the edge of side wall 3, which is oriented inward at right angles, and is fastened there by screws, for example. An upward-oriented leg of upper securing element 30 parallel to the plane of side wall 3, in its position relative to the mounted side wall 3, is aligned with the position of the associated upper counterpart securing element 500 and has an opening for a securing screw 300, which opening, in the exemplary embodiment shown, is embodied in the form of a horizontal slot-shaped opening, which is thus oriented at a right angle to the slot-shaped opening of upper counterpart securing element 500, thus enabling a horizontal and vertical adjustment of side wall 3. According to the number and position of upper counterpart securing elements 500, a plurality of upper securing elements 30 that are matched to the latter in their positions and dimensions are mounted to side wall 3, as shown in FIG. 6B.

Figure 6C:
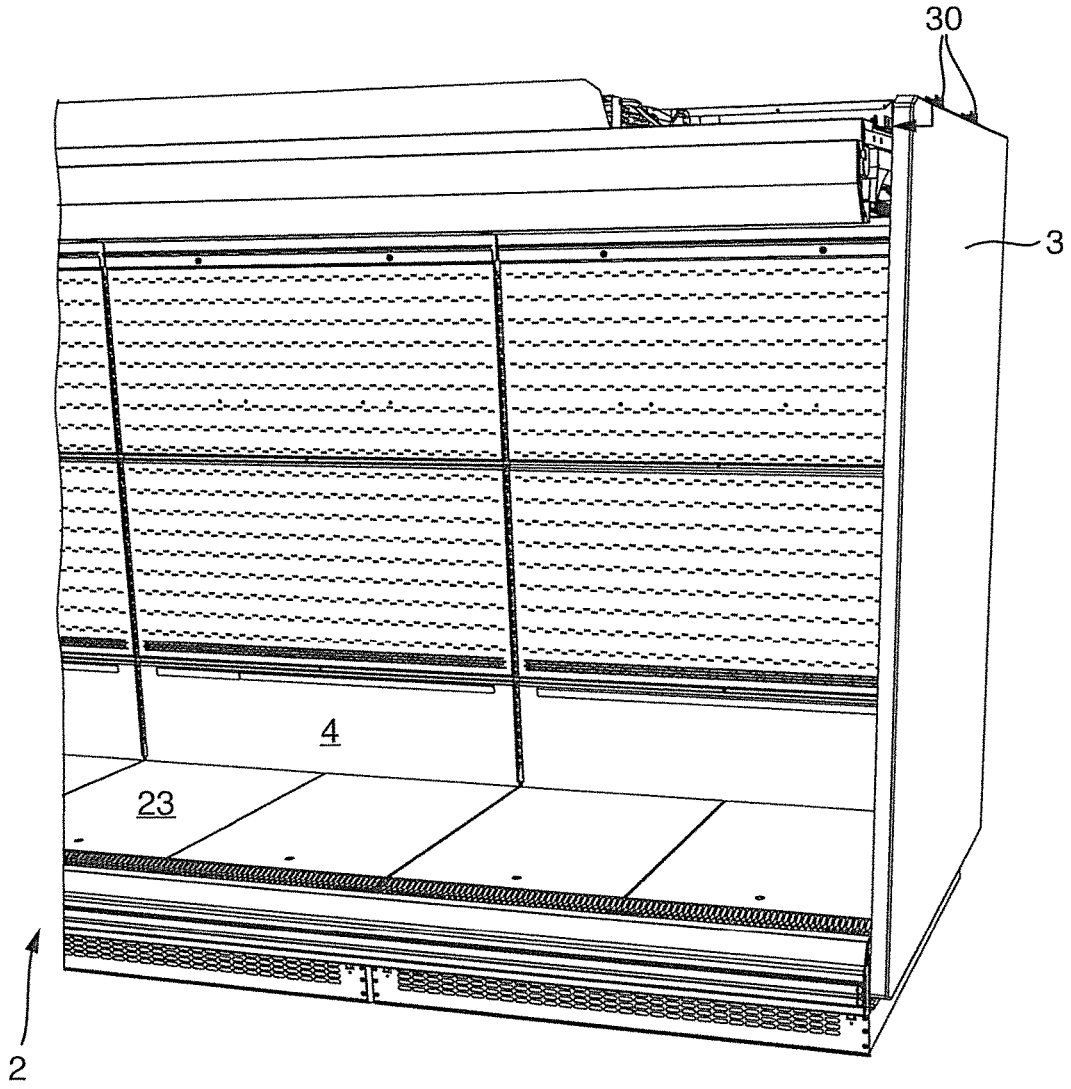
FIG. 6C is a perspective view of the detail of the refrigerated display case with a symbolic depiction of mounting steps for the side wall.
Figure 6D:
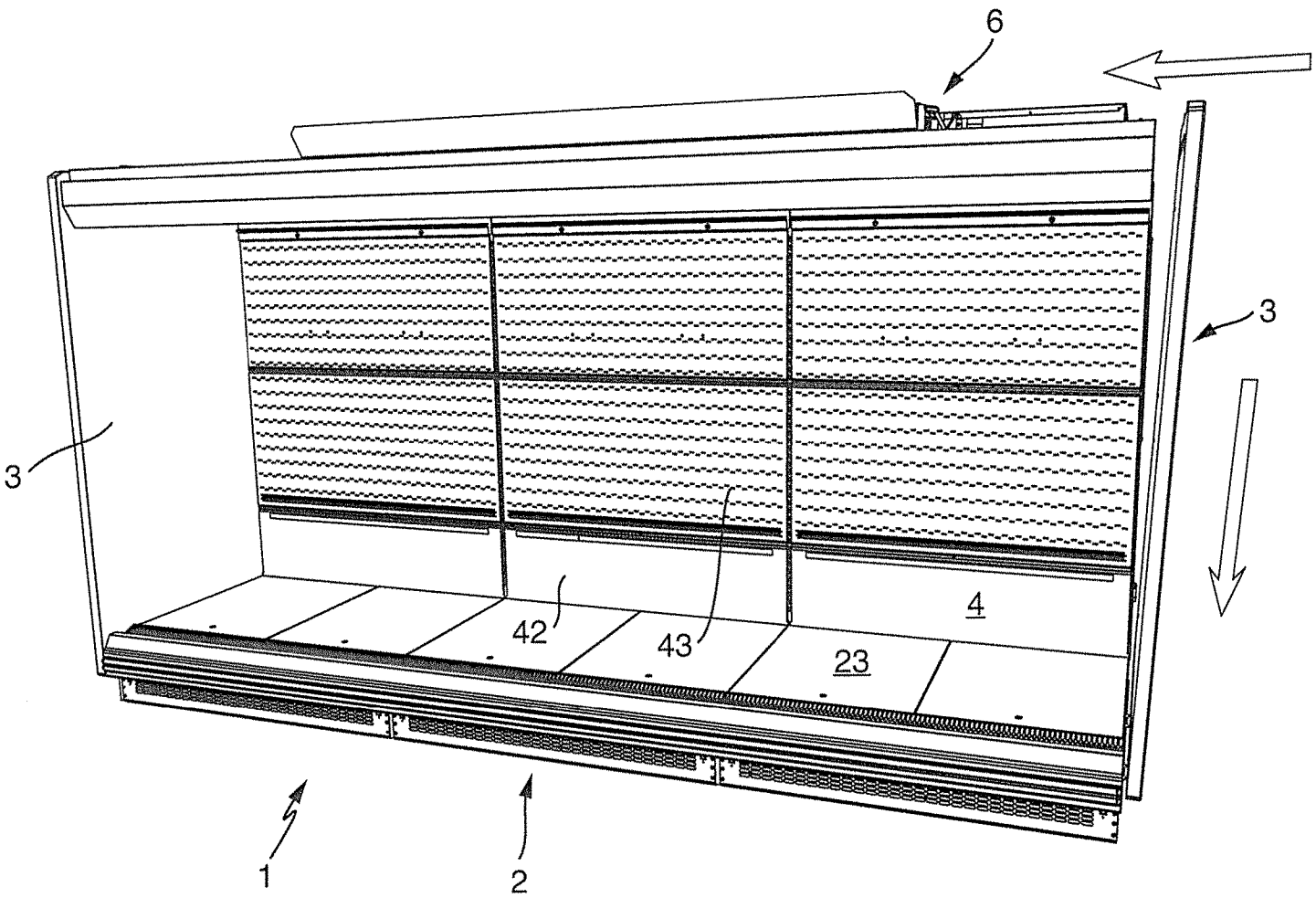
FIG. 6D is a perspective view of the refrigerated display case according to FIG. 1 with a symbolic depiction of mounting steps.
Figure 6E:
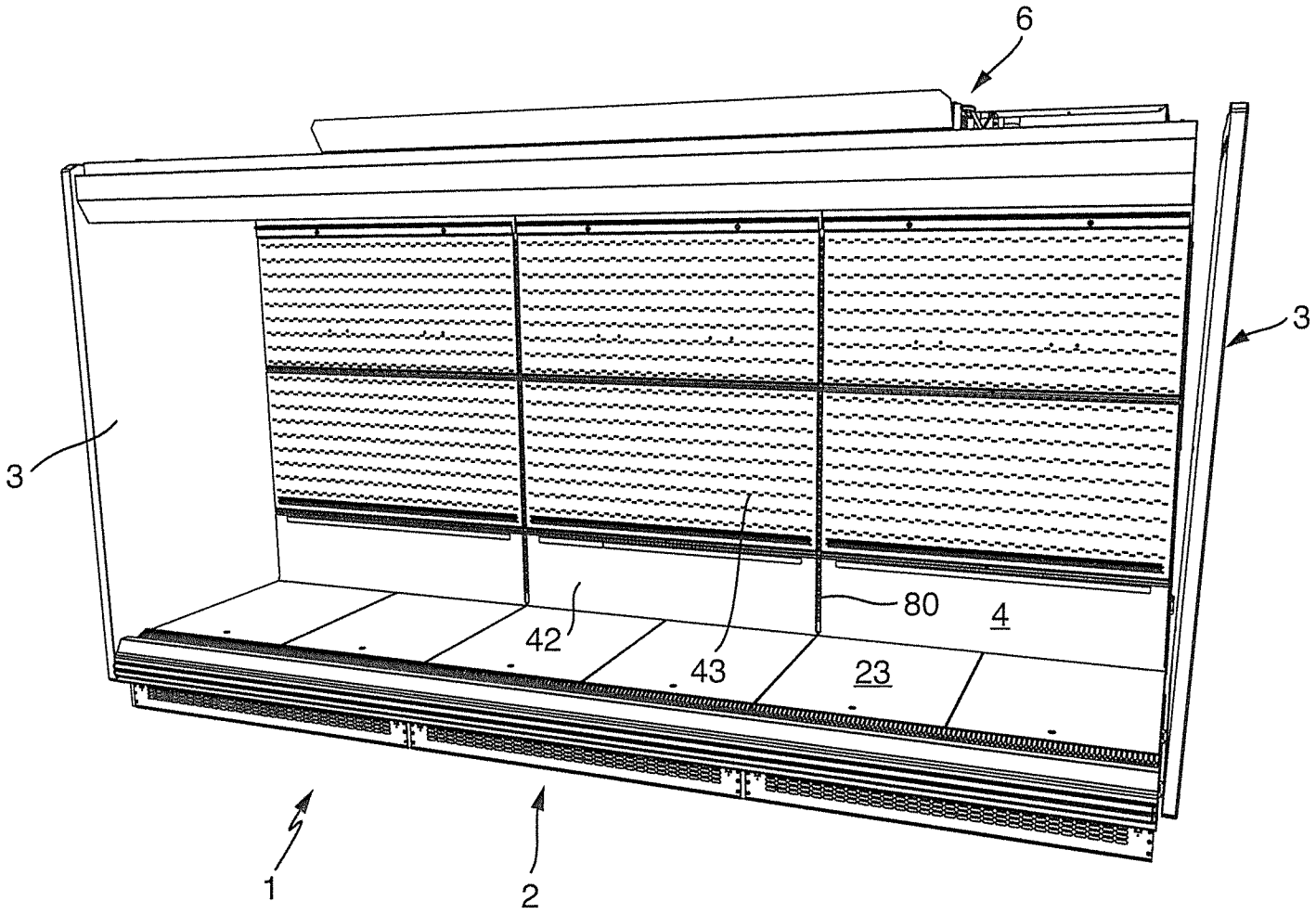
FIG. 6E is a perspective view of the refrigerated display case according to FIG. 1 with a first, partially mounted side wall.

FIGS. 6C, 6D, and 6E show the procedure of the mounting of side walls 3 of refrigerated display case 1. First, as shown in FIG. 6C, the side wall is inserted with its lower securing elements 31 into lower counterpart securing elements 200 and then in its upper region, is pivoted against the lateral edges of top assembly 5 and rear wall assembly 4 or more precisely against top strut 50 and vertical strut 40. Then upper securing elements 30 of side wall assembly 3 are secured to upper counterpart securing elements 500 by securing screws 300.

Refrigerated display case 1 is advantageously provided with a cooling device 6, which has an inclined plate heat exchanger situated on top, which is connected via a large lateral manifold to other cooling components in rear wall assembly 4. Another advantageous embodiment is comprised of a hybrid unit on the top of refrigerated display case 1. The hybrid unit has a plate heat exchanger with air cooling for dissipating heat to the surroundings of the display case if the room temperature is relatively low and also has a heat exchanger for connection to a central heat exchanger if the ambient temperature of refrigerated display case 1 or other requirements make it advisable to dissipate the heat into a room remote from refrigerated display case 1. The hybrid unit is embodied so that a controlled change-over by a control unit takes place, e.g., as a function of the ambient temperature of refrigerated display case 1. For the plate heat exchanger, a particular routing of air across the back side of the display case is provided in order to avoid a short circuit in the air flow.

Another advantageous embodiment relates to the positioning of the compressor of cooling device 6. The compressor housing for the compressor is adapted to the shape of the compressor; a shell-like envelope made of plastic with a lateral fastening flange and a lower end wall is provided. The compressor housing is positioned in the lower part of the rear wall, for example in the middle region relative to the width, and is mounted from the inside. In comparison to the mounting from the outside, this embodiment brings advantages with regard to air routing, thermal and sound insulation, and accessibility from the cooling chamber; the embodiment of the rear wall assembly with support struts 80 that are shifted forward, spaced apart from the rear offers advantages in this regard.

A wide variety of materials are available for the various parts discussed and illustrated herein. While the principles of this invention have been described in connection with specific embodiments, it should be understood clearly that these descriptions are made only by way of example and are not intended to limit the scope of the invention.

The invention claimed is:

1. A refrigerated display case comprising:

a bottom assembly with lower lateral edges, a top assembly with upper lateral edges, a rear wall assembly and side walls;

a cooling chamber at the bottom assembly; and lower securing elements in a lower region of the sidewalls and upper securing elements in an upper region of the sidewalls;

wherein the lower lateral edges of the bottom assembly near the side walls include the lower securing elements which are adapted to interact with corresponding lower counterpart securing elements and the upper lateral edges of the top assembly near the side walls are provided with upper counterpart securing elements, the side walls being detachably secured to the refrigerated display case by connecting the lower securing elements to the corresponding lower counterpart securing elements and by connecting the upper securing elements to the corresponding upper counterpart securing elements, the upper securing elements are securing angles having an inward-oriented fastening leg that is mounted to an upper edge of the respective side wall at a right angle to the plane of the side wall and with an upward-oriented connecting leg, the upper counterpart securing elements are Z-shaped angled elements with a downward-oriented additional fastening leg, an outward-oriented middle support leg, and an upward-oriented counterpart connecting leg, and the connecting leg and the counterpart connecting leg are each provided with at least one longitudinal slot, a first slot is oriented vertically and a second slot is oriented horizontally, the slots can be aligned and connected by a retaining screw.

2. The refrigerated display case according to claim 1 wherein each side wall can be hung at an angle from above with the lower securing elements in the lower counterpart securing elements and can then be pivoted against the upper lateral edge of the rear wall assembly and the top assembly and can then be secured by the upper securing elements to the upper counterpart securing elements by one or more retaining elements, thereby preventing the side wall from being lifted out of the lower counterpart securing elements.

3. The refrigerated display case according to claim 2 wherein the retaining elements are screws.

4. The refrigerated display case according to claim 1 wherein each respective side wall can be hung by the upper securing elements in the upper counterpart securing elements and can then be pivoted against the lower lateral edge of the rear wall assembly and the bottom assembly and can be secured with the lower securing elements to the lower counterpart securing elements by the retaining elements to prevent the side wall from being removed from the upper counterpart securing elements.

5. The refrigerated display case according to claim 1 wherein the lower securing elements are securing angles having a fastening leg that is mounted to a lower edge of the respective side wall extending inward at a right angle to the plane of the side wall and with a downward-oriented hanging leg, the lower counterpart securing elements are counterpart securing angles having a fastening leg that is mounted to the respective lateral edge of the bottom assembly and with an outward-protruding hanging leg.

6. The refrigerated display case according to claim 1 wherein each side of the refrigerated display case includes a C-shaped side frame, the C-shaped side frame has a vertical side strut extending along the lateral edge of the rear wall assembly, a top side strut connected to the upper end section thereof and extending along the lateral edge of the top assembly, and a bottom side strut connected to the lower end section of the vertical strut and extending along the lateral edge of the bottom assembly, the upper counterpart securing elements are mounted to the top side strut and the lower counterpart securing elements are mounted to the bottom side strut directly or indirectly by intermediate elements.

7. The refrigerated display case according to claim 1 wherein the side walls include an upper region, rear region and lower region, the upper, rear and lower regions having an exterior metal plate, the metal plate being bent inward toward the cooling chamber at a right angle to a plane of the plate along its rear, upper, and lower edges.

* * * * *